US009617676B2

(12) United States Patent
Kwon et al.

(10) Patent No.: US 9,617,676 B2
(45) Date of Patent: Apr. 11, 2017

(54) LAUNDRY TREATMENT APPARATUS

(71) Applicant: LG ELECTRONICS INC., Seoul (KR)

(72) Inventors: Oshin Kwon, Seoul (KR); Kyeonghwan Kim, Seoul (KR); Byunghyun Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/746,307

(22) Filed: Jun. 22, 2015

(65) Prior Publication Data

US 2015/0368843 A1 Dec. 24, 2015

(30) Foreign Application Priority Data

Jun. 23, 2014 (KR) ..... 10-2014-0076498
Jun. 23, 2014 (KR) ..... 10-2014-0076502
Jun. 23, 2014 (KR) ..... 10-2014-0076732

(51) Int. Cl.

| | |
|---|---|
| ***D06F 33/02*** | (2006.01) |
| ***D06F 37/04*** | (2006.01) |
| ***D06F 37/06*** | (2006.01) |
| ***D06F 37/20*** | (2006.01) |
| ***D06F 37/22*** | (2006.01) |
| ***D06F 37/30*** | (2006.01) |

(52) U.S. Cl.

CPC ..... *D06F 37/203* (2013.01); *D06F 37/22* (2013.01); *D06F 37/225* (2013.01); *D06F 37/30* (2013.01); *D06F 33/02* (2013.01); *D06F 37/04* (2013.01); *D06F 37/06* (2013.01); *D06F 37/304* (2013.01); *D06F 2202/065* (2013.01); *D06F 2204/10* (2013.01); *D06F 2222/00* (2013.01)

(58) Field of Classification Search

CPC ..... D06F 37/04; D06F 37/203; D06F 37/22; D06F 37/30
USPC ..... 68/12.06, 23.1, 23.2, 139, 140
See application file for complete search history.

(56) References Cited

U.S. PATENT DOCUMENTS

| | | | |
|---|---|---|---|
| 5,813,253 | A | 9/1998 | Uhlin |
| 2012/0084926 | A1 | 4/2012 | Lee et al. |
| 2013/0025330 | A1 | 1/2013 | Bae et al. |
| 2013/0327098 | A1 | 12/2013 | Bae et al. |

FOREIGN PATENT DOCUMENTS

| | | | |
|---|---|---|---|
| EP | 2551398 | A1 | 1/2013 |
| EP | 2671995 | A1 | 12/2013 |
| KR | 10-2011-0010945 | A | 2/2011 |
| KR | 10-2013-0017355 | A | 2/2013 |

(Continued)

*Primary Examiner* — Michael Barr
*Assistant Examiner* — Levon J Shahinian
(74) *Attorney, Agent, or Firm* — Dentons US LLP

(57) ABSTRACT

A laundry treatment apparatus including a cabinet forming an appearance of the apparatus, a drum rotatably disposed in the cabinet, a housing fixed to the drum, an accommodation space defined within the housing forming a closed loop, a balancing unit movably disposed in the accommodation space, and a housing power line provided at an inner circumferential surface of the housing to supply power to the balancing unit, wherein the balancing unit includes a unit body, a motor for moving the unit body, a brush contacting the housing power line, and a power terminal housing fixed to the unit body and having a space in which the brush is removably installed.

12 Claims, 17 Drawing Sheets

(56) References Cited

FOREIGN PATENT DOCUMENTS

| | | | |
|---|---|---|---|
| KR | 10-2013-0114478 | A | 10/2013 |
| WO | 2013/022164 | A2 | 2/2013 |
| WO | 2013/183929 | A1 | 12/2013 |

(a)

(b)

(a)

(b)

LAUNDRY TREATMENT APPARATUS

Pursuant to 35 U.S.C. §119(a), this application claims the benefit of Korean Patent Application No. 10-2014-0076732, No. 10-2014-0076502, and No. 10-2104-0076498, each filed on Jun. 23, 2014, and each of which is hereby incorporated by reference as if fully set forth herein.

BACKGROUND

Field

The present disclosure relates to a laundry treatment apparatus.

Discussion of the Related Art

A conventional laundry treatment apparatus includes a cabinet defining an appearance of the apparatus, a tub installed in the cabinet, a drum rotatably installed in the tub to wash laundry, and a motor having a rotating shaft, coupled to the drum while passing through the tub, to rotate the drum.

The drum may rotate without maintaining of dynamic equilibrium (dynamic balance) depending on a position of laundry disposed therein.

"Dynamic equilibrium" means a state that, during rotation of a rotating body, centrifugal force of the rotating body or a moment caused by the centrifugal force becomes zero with respect to the axis of rotation. In the case of a rigid body, dynamic equilibrium is maintained when mass of the rigid body is evenly distributed about the axis of rotation.

Dynamic equilibrium of a laundry treatment apparatus may be considered as a state wherein the mass distribution of laundry about an axis of rotation of a drum including laundry contained therein falls within an allowable range during rotation of the drum (a state in which the drum rotates within an allowable amplitude range of vibration).

Meanwhile, a state wherein the dynamic equilibrium in a laundry treatment apparatus is lost (a state of unbalance) means that mass distribution of laundry about the axis of rotation of a drum is non-uniform during rotation of the drum. Loss of dynamic equilibrium occurs when laundry is not evenly distributed about an inner surface of the drum.

When a drum rotates in an unbalanced state, vibration is generated. The vibration of the drum is transmitted to a tub or a cabinet thus causing generation of noise.

Among conventional laundry treatment apparatuses, there is an apparatus equipped with a balancer for improving an unbalanced state of a drum. A balancer incorporated in conventional laundry treatment apparatuses is a ball balancer or a fluid balancer in which a ball or fluid is contained in a housing fixed to a drum.

When a drum is in the unbalanced state, the drum exhibits the highest rotational speed when laundry incurring the unbalanced state passes through the lowest point of the rotational orbit of the drum and exhibits the lowest rotational speed when the laundry incurring the unbalanced state passes through the highest point of the rotational orbit of the drum.

Therefore, the ball balancer or the fluid balancer incorporated in conventional laundry treatment apparatuses controls unbalance in such a manner that a ball or fluid moves toward the lowest point of a rotational orbit of a drum when laundry causing the unbalanced state moves toward the highest point.

Although the above-mentioned unbalance control is useful under the vibration condition in a steady state in which amplitude of vibration of a drum falls within a predetermined range, satisfactory effects cannot be obtained under transient vibration to which the drum is subjected before vibration of the drum reaches the steady state.

Furthermore, conventional balancing units have difficulty in immediately resolving (actively resolving) unbalance upon occurrence thereof.

In addition, a brush of a conventional balancing unit suffers from structural deformation upon contacting a power supply line provided at a housing.

Furthermore, since a brush of a conventional balancing unit is directly connected to a power cable of a motor through soldering, there is a problem of deterioration of durability.

In addition, according to the conventional technologies, since a balancer is connected by a wire (electric wire) for supply of electricity to the balancer and washing water is introduced into a drum, problems in safety may occur.

SUMMARY

Accordingly, the present disclosure is directed to a laundry treatment apparatus that substantially obviates one or more problems due to limitations and disadvantages of the related art.

One object is to provide a laundry treatment apparatus which is configured to actively resolve unbalanced rotation of a drum containing laundry.

Another object is to provide a laundry treatment apparatus including a balancer equipped with at least two balancing units which are independently movable in a housing fixed to a drum.

A further object is to provide a laundry treatment apparatus including a device for safely and easily connecting lines to each other to supply power to balancing units.

Still another object is to provide a laundry treatment apparatus which is capable of supplying electric power in a wired manner to at least two balancing units moving independently in a housing fixed to a drum.

A further object is to provide a laundry treatment apparatus including a balancing unit equipped with a brush that is not easily deformed.

Still another object is to provide a laundry treatment apparatus including a balancing unit equipped with a brush removably coupled to a connector.

Additional advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with at least one purpose of the invention, as embodied and broadly described herein, a laundry treatment apparatus includes a cabinet forming an appearance of the apparatus, a drum rotatably disposed in the cabinet, a housing fixed to the drum, an accommodation space defined within the housing forming a closed-loop, a balancing unit movably disposed in the accommodation space, and a housing power line provided at an inner circumferential surface of the housing to supply power to the balancing unit, wherein the balancing unit may include a unit body disposed in the accommodation space, a motor for moving the unit body in the accommodation space, a brush contacting the housing power line, and a power terminal housing fixed to the unit body and having a space in which the brush is removably installed.

The brush may include a first leg removably provided in the power terminal housing, a second leg removably provided in the power terminal housing, and at least one curved portion connected between the first leg and the second leg.

The laundry treatment apparatus may further include at least one power terminal disposed in the power terminal housing to transmit power to the motor, wherein the first leg is disposed to contact the power terminal.

The first leg may have a longer length than that of the second leg.

The power terminal housing may include a unit power line connecting the power terminal to the motor to transmit power to the motor.

The at least one curved portion may be disposed to contact the housing power line, and includes a first curved portion and a third curved portion which receive power from the housing power line.

The at least one curved portion may include a second curved portion positioned between the first and third curved portions and disposed in the power terminal housing.

The laundry treatment apparatus may further include at least one power terminal disposed in the power terminal housing to transmit power to the motor, wherein the at least one curved portion may include a first curved portion and a third curved portion which receive power from the housing power line.

The at least one curved portion may include a second curved portion disposed between the first curved portion and the second curved portion, wherein the second curved portions is disposed to contact the power terminal.

The power terminal housing may include a unit power line connecting the power terminal to the motor to transmit power to the motor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings:

FIG. 3(*b*) is a cross-sectional view illustrating the balancing unit incorporated in the laundry treatment apparatus according to the present invention;

FIG. 7(*b*) is a cross-sectional view illustrating the rotation transmission member including holding portions according to the present invention;

DETAILED DESCRIPTION

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the scope of the invention is not limited thereto. Wherever possible, the same reference numbers will be used throughout the drawings to refer to the same or like parts.

Figure 1:
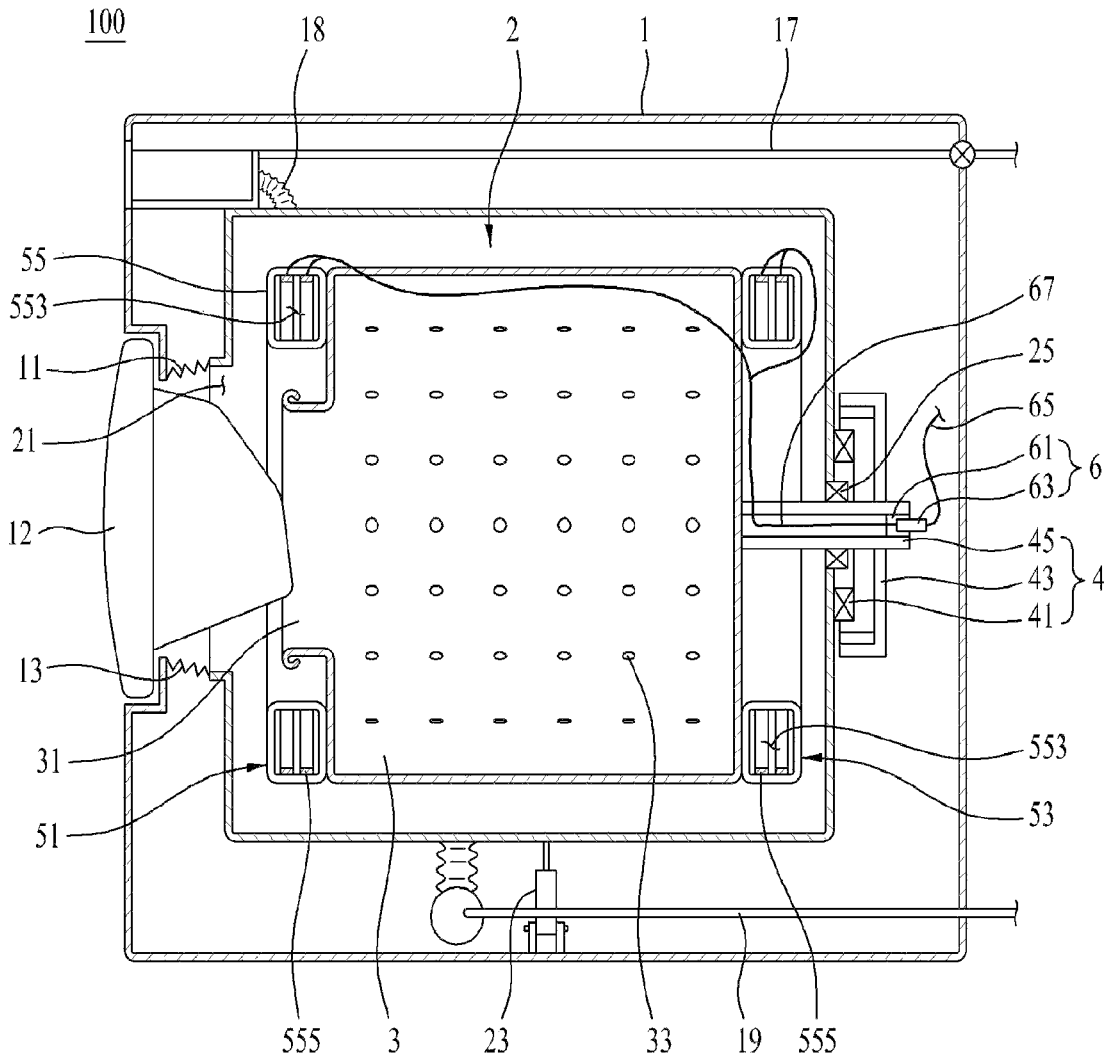
FIG. 1 is a cross-sectional view illustrating a laundry treatment apparatus according to an embodiment of the present invention.

FIG. 1 illustrates a laundry treatment apparatus according to one embodiment of the present invention. As shown in FIG. 1, the laundry treatment apparatus includes a cabinet 1 defining an appearance of the apparatus, a tub 2 provided at the cabinet 1, a drum 3 rotatably provided in the tub 2 to receive laundry, and balancers 51 and 53 provided at the drum 3 to attenuate unbalance of the drum 3.

Cabinet 1 includes an introduction port 11 for allowing introduction and retrieval of laundry, and a door 12 for opening and closing the introduction port 11.

Tub 2 defines therein a space for accommodating washing water, and includes a tub inlet 21 communicating with the introduction port 11. Tub 2 is secured in the cabinet 1 via a tub support 23.

Tub support 23 serves to attenuate vibration generated from the tub 2 by means of a damper or a spring.

Gasket 13 may be provided between the introduction port 11 and the tub inlet 21. The gasket 13 is intended to prevent the washing water in the tub from leaking into the cabinet 1, and is preferably made of a resilient material so as to block transmission of vibration of the tub 2 to the cabinet 1.

Meanwhile, the cabinet 1 may further be provided with a water supply pipe 17 to supply washing water into the tub 2, and a water discharge pipe 19 for allowing the washing water in the tub 2 to be discharged from the cabinet 1.

In addition, the cabinet 1 may further include a detergent box 15 for supplying detergent into the tub 2. Detergent box 15 may be embodied as a drawer type box that may be pulled out of a front surface of the cabinet 1 (the surface of the cabinet 1 at which the introduction port 11 is provided).

Detergent box 15 may be connected to a water supply source (not shown) via the water supply pipe 17, and may be connected to the tub 2 via a detergent supply pipe 18. Consequently, as washing water is supplied through the water supply pipe 17, the detergent stored in the detergent box 15 is supplied into the tub 2 through the detergent supply pipe 18.

Drum 3 includes a drum inlet 31 communicating with the tub inlet 21. Consequently, laundry may be put into or taken out of the drum 3 through the introduction port 11, the tub inlet 21, and the drum inlet 31.

Drum 3 includes a plurality of drum through-holes 33 that are perforated through a circumferential wall of the drum 3. The drum through-holes 33 are intended not only to allow the washing water in the tub 2 to be introduced into the drum 3 but also to allow washing water extracted from laundry to be discharged into the tub 2.

Drum 3 is rotated by means of a drive unit 4 which is provided outside the tub 2.

Drive unit 4 may include a stator 41 fixed to a rear surface of the tub 2, a rotor 43 adapted to be rotated by a rotating magnetic field generated from the stator 41, and a rotating shaft 45 extending through the rear surface of the tub 2 so as to connect the drum 3 to the rotor 43.

Tub 2 may further include a shaft bearing 25 for rotatably supporting the rotating shaft 45.

Shaft bearing 25 is provided in a bearing housing 27 provided at the rear surface of the tub 2.

Meanwhile, the drum 3 is provided with the balancers 51 and 53 that serve to control vibration generated from the drum 3. In this regard, the balancer 51 and 53 may be provided at only one of front and rear surfaces of the drum 3, or may be provided at both the front and rear surfaces of the drum 3.

FIG. 1 illustrates an example in which both the balancers are provided, that is, the front balancer 51 is provided at the front surface of the drum 3 and the rear balancer 53 is provided at the rear surface of the drum 3.

Since the front balancer 51 and the rear balancer 53 have the same internal configuration except for positions thereof, the configuration of a balancer which will be described hereinafter may be applied to both the front and rear balancers 51 and 53.

Figure 2:
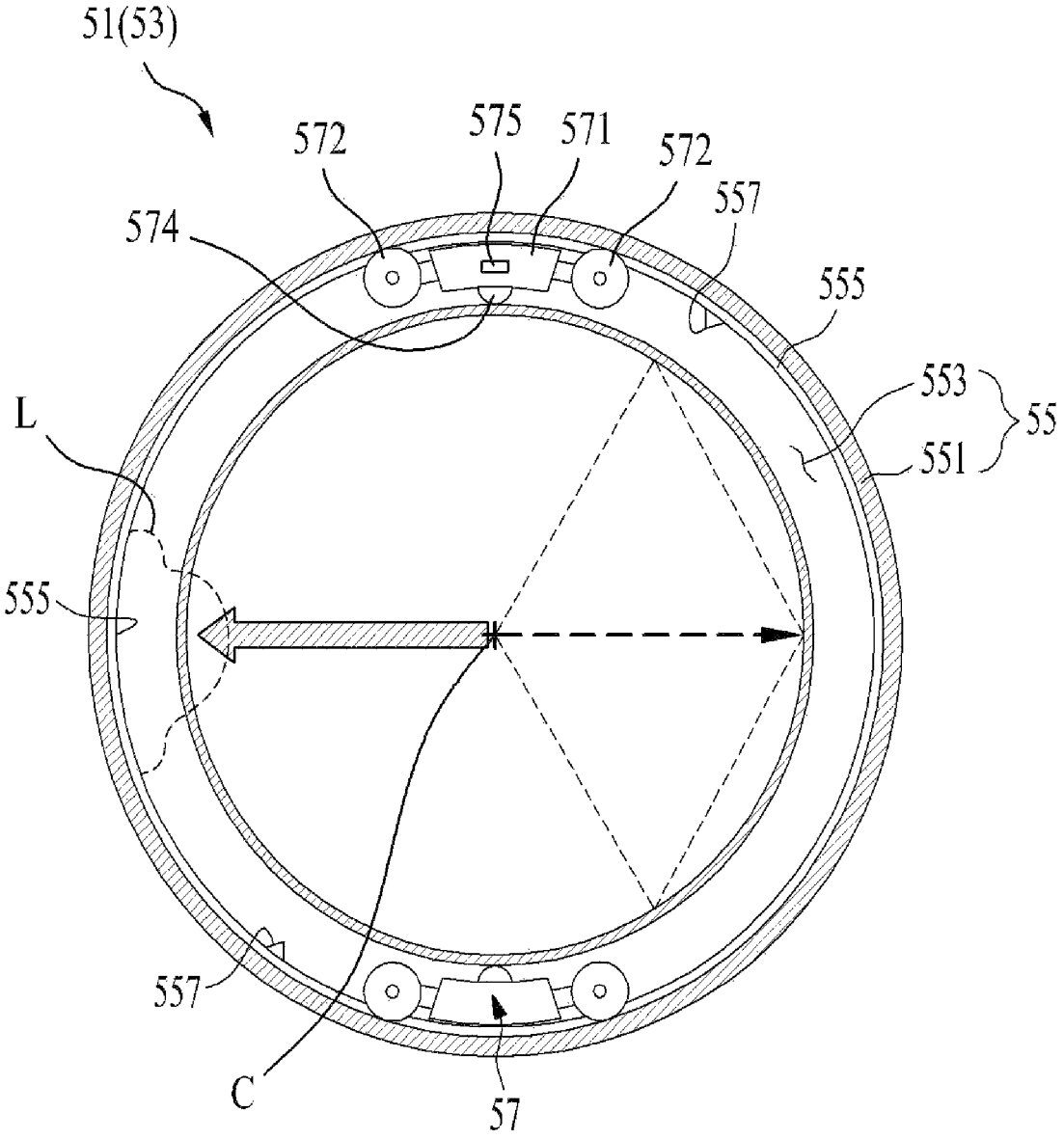
FIG. 2 is a view illustrating a balancer incorporated in the laundry treatment apparatus according to the present invention.

FIG. 2 illustrates a balancer incorporated in the laundry treatment apparatus according to the present invention. As shown in FIG. 2, each of the balancers 51 and 53 includes a housing 55 fixed to the drum 3, and balancing units 57 movably provided in the housing 55.

Housing 55 includes a housing body 551 fixed to the drum 3, and an accommodation space 553 defined in the housing body 551 and exhibiting a circular orbit.

Housing body 551 may be embodied as any configuration so long as such configuration does not close the drum inlet 31. FIG. 2 illustrates the housing body 551 which is embodied into an annular shape by way of example.

Although the accommodation space 553 is preferably shaped into a true circle having a constant radius, it may be embodied into an imperfect circle (an elliptical shape and the like) having a varying radius that is locally different so long as the balancing units 57 are movable.

Housing body 551 defining the accommodation space 553 is provided at an internal surface thereof with housing power lines 555 connected to a power supply 6 which will be described later. Housing power lines 555 may further be provided with protrusions 557 or grooves (not shown) so as to bring about variation in an amount of current.

Protrusions 557 may be formed into any shape so long as they cause variation in cross-sectional area of the housing power lines 555. The grooves may be formed into any shape so long as they cause angular variation of a surface of the power lines 555.

Protrusions 557 and the grooves (not shown) are provided so as to enable a control unit (not shown) to detect positions of the balancing units 57.

The number of the balancing units 57 according to the present invention is preferably at least two in order to prevent unbalance of the drum 3 caused by the balancing units 57. The balancing units 57 may be the same or essentially the same.

Figure 3A:
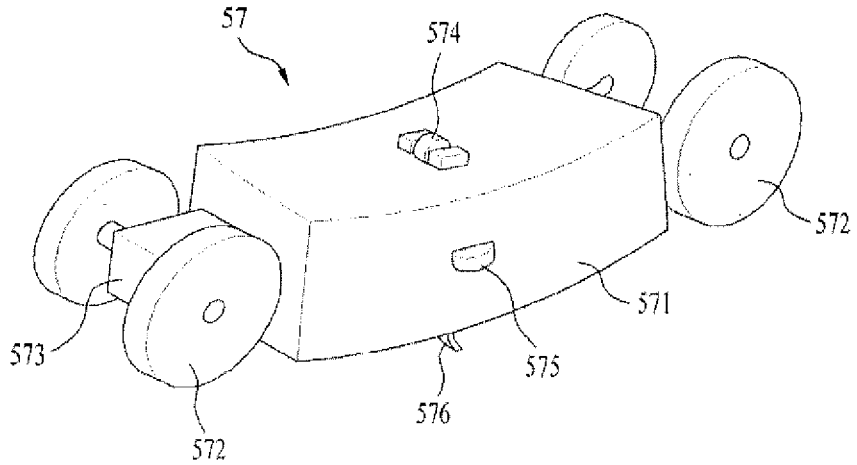
FIG. 3(*a*) is a view illustrating a balancing unit incorporated in the laundry treatment apparatus according to the present invention.
Figure 3B:
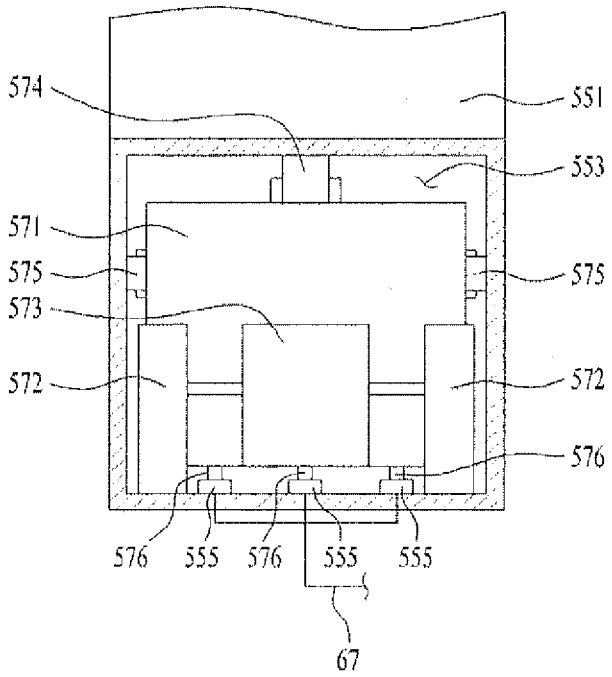

FIG. 3 illustrates balancing units incorporated in the laundry treatment apparatus according to the present invention. As shown in FIG. 3, the balancing unit 57 includes a unit body 571 that is sized to be movable along the accommodation space 553, a motor 573 provided at the unit body 571, wheels 572 adapted to support the unit body 571 and which are rotated by the motor 573, and unit power lines 576 provided at the unit body 571 to supply electric power (electric energy) supplied to the housing power lines 555 to the motor 573.

Wheels 572 may be provided at the front and the rear of the unit body 571, and the motor 573 may be constructed to drive only one pair of wheels of the front pair and rear pair of wheels 572.

Unit body 571 may be provided at any one of a top surface and both lateral surfaces thereof with a spacer such that a constant spacing is maintained between an external surface of the unit body 571 and the internal surface of the housing body 551.

The spacer may include a first subsidiary wheel 574 provided at the top surface of the unit body 571, and second subsidiary wheels 575 provided at the opposite lateral surfaces of the unit body 571, respectively.

The first subsidiary wheel 574 and the second subsidiary wheels 575 are preferably rotatably provided at the unit body 571.

In this example, the housing power lines 555 may be secured to the inner surface of the housing body 551 defining the accommodation space 553 such that they are positioned under the unit body 571 or at the opposite lateral surfaces of the unit body 571.

Since the unit power lines 576 are secured to the unit body 571 while being in contact with the housing power lines 555, the unit power lines 576 are held in a state of contacting the housing power lines 555 regardless of the position of the balancing unit 57 in the accommodation space 553.

Consequently, the balancing unit 57 which moves in the accommodation space 553 may be supplied with electric power from the housing power lines 555 through the unit power lines 576.

Meanwhile, the balancing unit 57 provided at the laundry treatment apparatus according to the present invention may further include a unit controller (not shown) for controlling operation of the motor 573 and a unit communicator (not shown) for transmission and reception of data.

In this case, the laundry treatment apparatus according to one embodiment of the present invention may further include a control unit (not shown) for controlling the drive unit 4 or supply and discharge of washing water (opening and closing of the water supply pipe 17 or the water discharge pipe 19) and a communication unit (not shown) for exchange of data with the unit communicator (not shown).

Accordingly, when unbalance occurs at the drum 3, the control unit (not shown) transmits control data to the unit communicator through the communication unit (not shown) so as to move the balancing unit 57 to a position at which unbalance is attenuated. Based on the control data received at the unit communicator, the unit controller moves the balancing unit 57 to a predetermined position (at which unbalance is attenuated), thus attenuating unbalance caused by the drum 3.

As described above, the housing power lines 555 are provided at the inner surface of the housing body 551 defining the accommodation space 553.

In other words, the housing power lines 555 may be supplied with power from the power supply 6.

Figure 4:
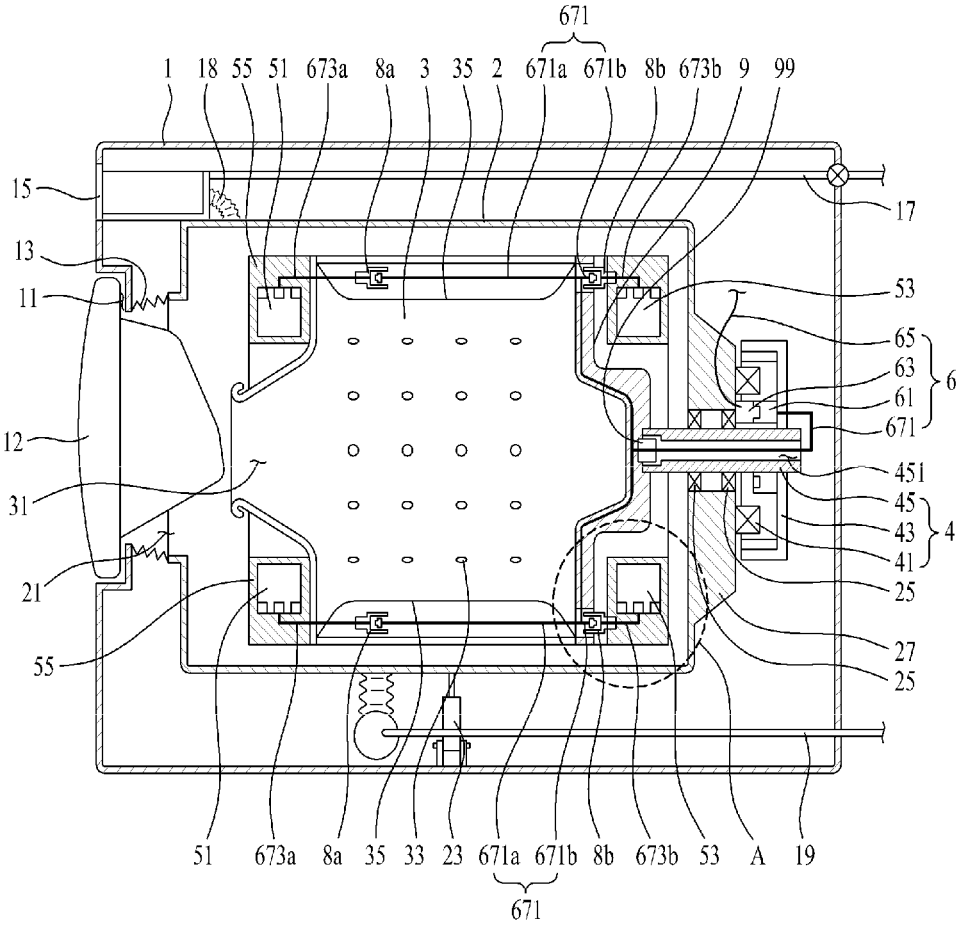
FIG. 4 is a cross-sectional view illustrating a laundry treatment apparatus according to another embodiment of the present invention.

Referring to FIG. 4, the power supply 6 may include a second power supply part 63 fixedly provided at a rear external surface of the tub 2.

Second power supply part 63 may be connected to a power source line 65 connected to a power source.

Power supply 6 may be connected to the second power supply part 63, and may include a first power supply part 61 fixed to the rotating shaft 45 or the rotor 43.

Power supply 6 may include a first connecting line 671 connected to the first power supply part 61.

Rotating shaft 45 may extend through a rear wall of the tub 2 and be fixed to the drum 3. Rotating shaft 45 may include a shaft through-hole 451 centrally and longitudinally formed in the rotating shaft 45.

First connecting line 671 may be fixedly received in a groove formed at an outer surface of the rotating shaft 45, or may be connected to the drum 3 through the shaft through-hole 451. Explanation of the first connecting line 671 will be given later.

In addition to the example illustrated in FIG. 4, other examples of the first power supply part 61 and the second power supply part 63 are now described.

First power supply part 61 may be partially secured in the shaft through-hole 451, and the second power supply part 63 may be partially and electrically connected to the first power supply part 61 in a rotatable manner.

In this regard, the first connecting line 671 connected to the first power supply part 61 is connected to the drum 3 through the shaft through-hole 451. Specifically, the first connecting line 671 is connected to the first power supply part 61 provided in the shaft through-hole 451 without passing through the shaft through-hole 451 and is connected at one end thereof to the drum 3. Explanation of the first connecting line 671 will be given later.

The laundry treatment apparatus according to one embodiment of the present invention may further include a sealing member 99 provided in the shaft through-hole 451 connected to the drum 3 in order to prevent introduction of washing water into the shaft through-hole 451.

First connecting line 671 may further be provided at an outer surface thereof with a waterproof member in order to protect the first connecting line 671 from washing water or hot air.

Drum 3 may be provided at a rear surface thereof with a rotation transmission member 9 to which the rotating shaft 45 is connected.

Rotation transmission member 9 may be integrally or detachably connected to the rotating shaft 45 to transmit torque (rotational force) to the drum 3.

Figure 6:
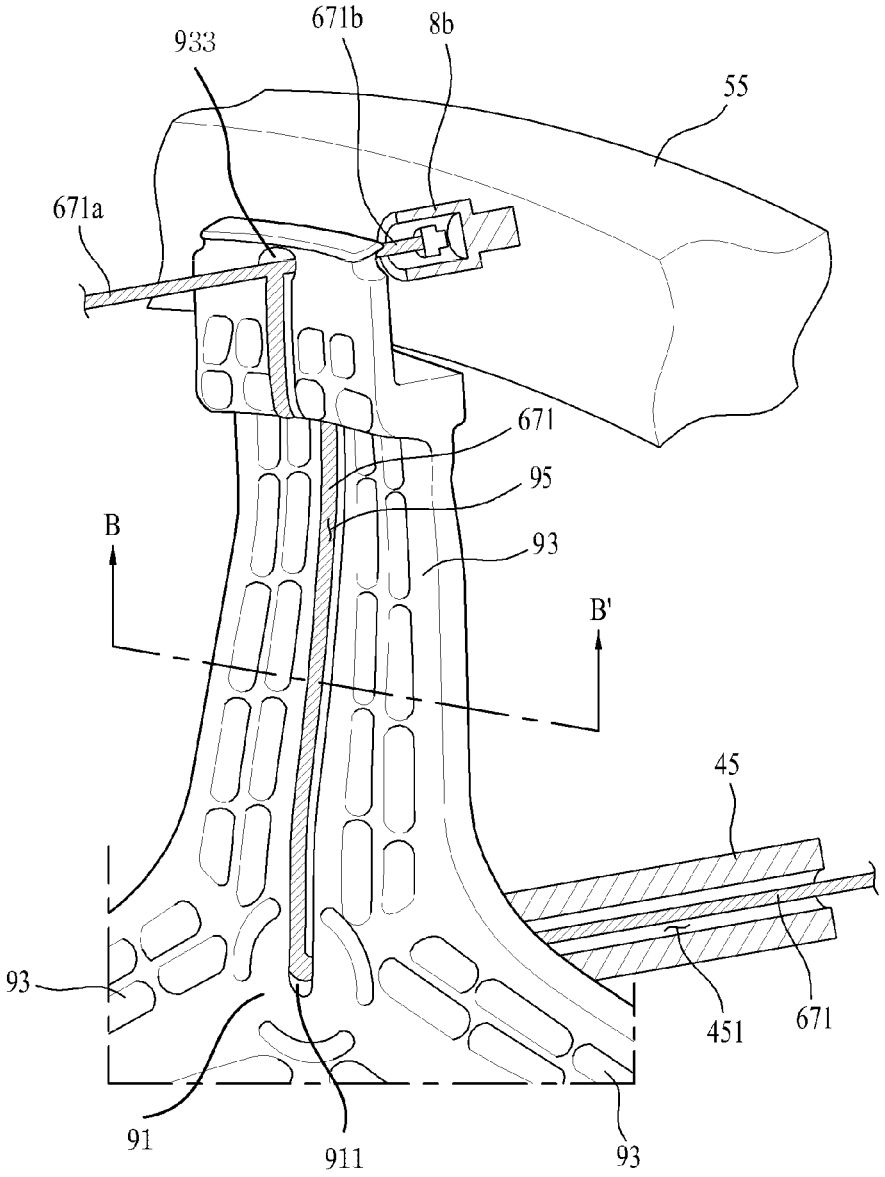
FIG. 6 is a view illustrating a rotation transmission member according to the present invention.

As illustrated in FIG. 6, although the rotation transmission member 9 may have a structure constituted by a core 91 to which the rotating shaft 45 is fixed and a plurality of extensions 93 extending from the core 91, the rotation transmission member 9 is not limited thereto and may have any structure capable of being fixed to the drum 3.

The plurality of extensions 93 may be fixed to the rear surface of the drum 3, and thus rotation of the rotating shaft 45 enables the drum 3 fixed to the extensions 93 to be rotated.

First connecting line 671 provided in the shaft through-hole 451 may extend through a core hole 911 centrally formed in the core 91.

Rotation transmission member 9 may include a guider 95 which receives the first connecting line 671 therein.

Guider 95 may be provided at a surface of the core 91 and a surface of the extension 93.

Guider 95 may have any shape capable of holding the first connecting line 671.

Figure 7A:
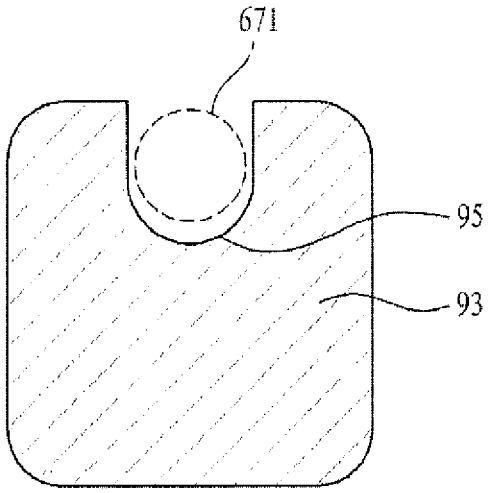
FIG. 7(*a*) is a cross-sectional view of the rotation transmission member having a guider according to the present invention, which is taken along line B-B' of FIG. 6.
Figure 7:
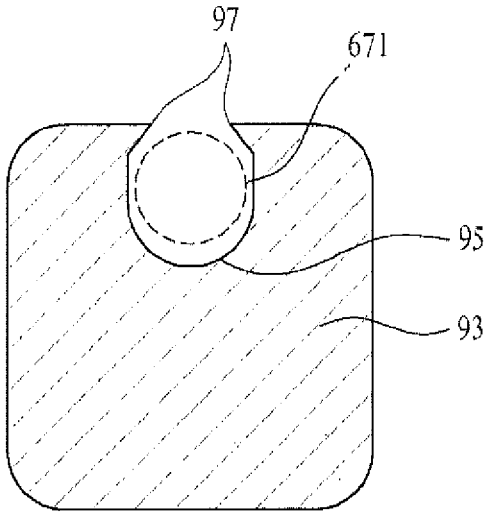

As illustrated in FIG. 7(*a*), in the laundry treatment apparatus according to the present invention, the guider 95 may be embodied as a groove formed at a surface of the rotation transmission member 9 contacting the drum 3.

Since the groove has a longer depth than a diameter of the first connecting line 671, the first connecting line 671 may be completely embedded in the groove.

Consequently, the first connecting line 671 received in the groove does not protrude from the surface of the rotating transmission member 9, and thus the rotation transmission member 9 may be closely fixed to the rear surface of the drum 3.

As illustrated in FIG. 7(*b*), the groove may include holding portions 97 at which the inner surface of the groove is connected to the surface of the rotation transmission member 9.

Although the maximum diameter of the groove is greater than a diameter of the first connecting line 671, the diameter of the groove having the holding portions 97 may be smaller than a diameter of the first connecting line 671.

Accordingly, when the first connecting line 671 is received in the groove having the holding portions 97, separation of the first connecting line 671 from the groove may be prevented.

Shaft through-hole 451 may include additional connecting sockets (not shown) provided at opposite ends thereof so as to connect the first connecting line 671 provided in the shaft through-hole 451 to the first connecting line 671 provided outside the shaft through-hole 451 through the connecting sockets. The connecting sockets serve to facilitate installation of the rotation transmission member 9 and the drive unit to the rear surface of the tub 2.

Rotating transmission member 9 may include a branch hole 933 formed at the end of the extension 93 (see FIG. 6).

First connecting line 671 may be branched at the branch hole 933 into a first front connecting line 671*a* connected to the front balancer 51 and a first rear connecting line 671*b* connected to the rear balancer 53.

First front connecting line 671*a* and the first rear connecting line 671*b* may be constructed in such a manner that a single first connecting line 671 is branched into two branched lines or two first connecting lines 671 corresponding to the two branched lines are initially provided.

Alternatively, the first front and rear connecting lines 671*a* and 671*b* and the first connecting line 671 may be provided as separate connecting line components, and the separate lines may be connected to one another at a connecting socket (not shown).

Although not shown in the drawings, the first connecting line 671 may extend through the branch hole 933 and may be branched into the first front connecting line 671*a* and the first rear connecting line 671*b* between the rotation transmission member 9 and the rear housing 55. The first front connecting line 671*a* may extend to the outside of the drum 3 so as to supply power to the front balancer 51.

First front connecting line 671*a* and the first rear connecting line 671*b* may be directly connected to the front and rear housing power lines 555, respectively, to supply power to the respective balancers 51 and 53.

The laundry treatment apparatus according to one embodiment of the present invention may further include second connecting lines connected to the front and rear housing power lines 555.

Figure 5:
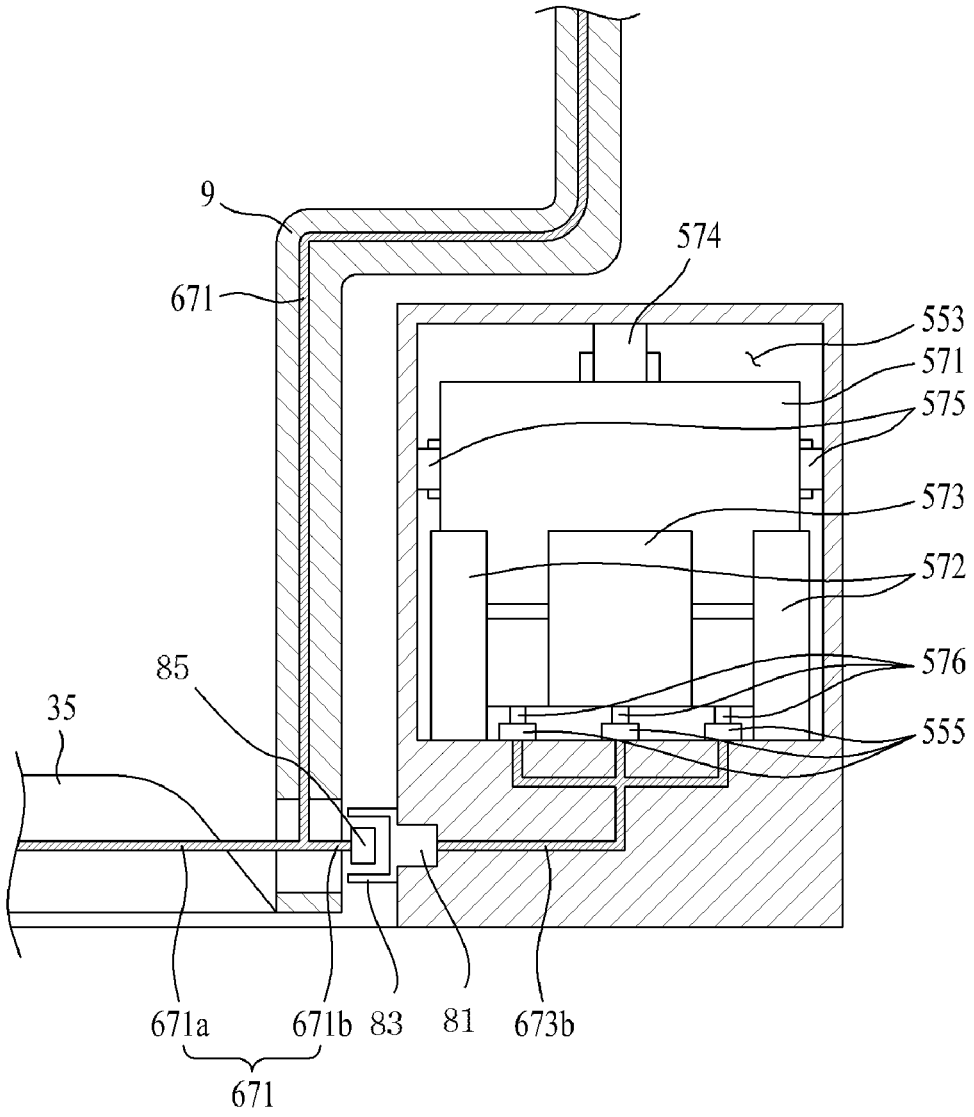
FIG. 5 is an enlarged view of circle A of FIG. 4.

The second connecting lines may include a second front connecting line 673*a* connected to the housing power lines 555 provided at the front balancer 51, and a second rear connecting line 673*b* connected to the housing power lines 555 provided at the rear balancer 53 (see FIGS. 4 and 5).

Thanks to further provision of the second connecting line, it is possible to prevent a problem where the balancers 51 and 53 and the housing 55 all have to be dismantled in order to replace the first connecting lines 671*a* and 671*b* when the first connecting lines 671*a* and 671*b* are directly connected to the housing lower lines 555.

The laundry treatment apparatus according to one embodiment of the present invention may further include a connector 8 for connecting the first connecting lines 671*a* and 671*b* to the second connecting lines 673*a* and 673*b* (see FIGS. 4 and 5).

The connector may include a front connector 8*a* for connecting the first front connecting line 671*a* to the second front connecting line 673*a*, and a rear connector 8*b* for the first rear connecting line 671*b* to the second rear connecting line 673*b*.

Since the front connector 8*a* and the rear connector 8*b* have the same structure, the structure of the connector, which will be described hereinafter, may be applied to any of the front connector 8*a* and the rear connector 8*b*.

Figure 8:
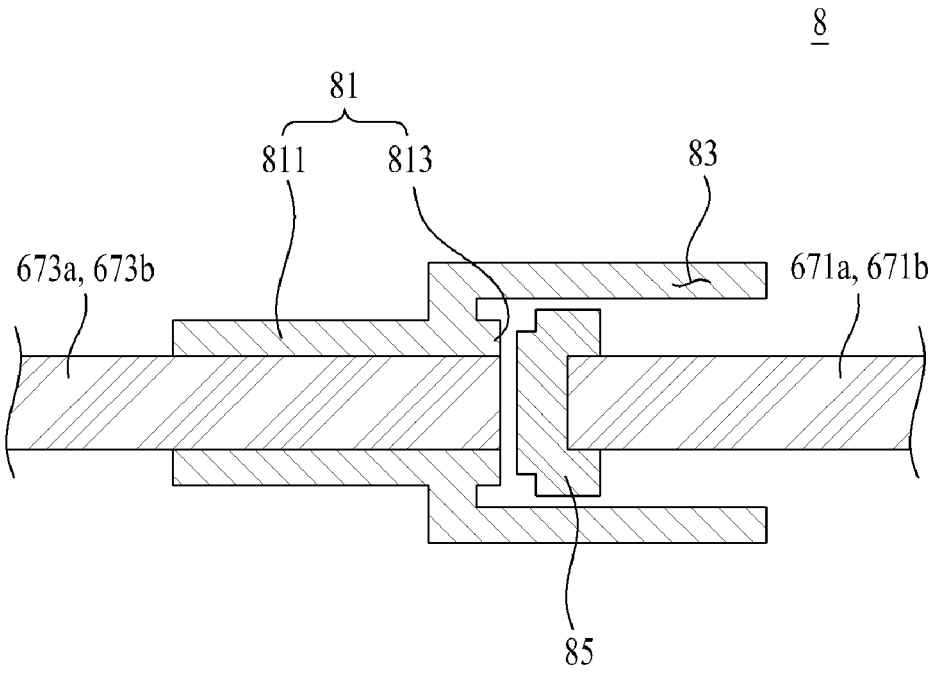
FIG. 8 is a cross-sectional view illustrating connectors according to the present invention.

As illustrated in FIG. 8, each of the connectors 8*a* and 8*b* may include a body part 81 through which the second connecting lines 673*a* and 673*b* pass, and a connecting part 85 to which the first connecting lines 671*a* and 671*b* are connected.

Body part 81 may include a first portion 813 electrically connected to the connecting part 85, and a second portion 811 in which the second connecting lines 673*a* and 673*b* are fitted for connection thereto.

First portion 813 may be made of a conductor material through which electric current may flow, and the second portion 811 may be made of an insulator material so as to prevent electric current from leaking to washing water through the connecting line.

Second portion 811 may include a clamp (not shown) for preventing washing water from infiltrating the second portion 811 after connection of the second connecting lines 673*a* and 673*b*.

Connecting part 85, to which the first connecting lines 671*a* and 671*b* are connected, may be detachably connected to the first portion 813 of the body part 81.

Connecting part 85 may be made of conductor which allows electric current to flow therethrough. As the connecting part 85 is disposed in a coupling part 83, which will be described later, this eliminates risk of current leakage to washing water.

The reason why the connecting part 85 and the body part 81 are detachably coupled to each other is to allow only the first connecting lines 671*a* and 671*b* to be easily replaced when the first connecting lines 671*a* and 671*b* are broken or disconnected.

Each of the connectors 8*a* and 8*b* may further include the coupling part 83 provided at the body part 81 and receiving the connecting part 85 to which the first connecting lines 671*a* and 671*b* are connected.

Coupling part 83 is provided at an end of the body part 81. Coupling part 83 may be provided therein with a first portion 813 of the body part 81 and may be externally provided with the second portion 811 made of an insulator for blocking current leakage.

Coupling part 83 may further include a clamp (not shown) for preventing washing water from infiltrating the coupling part 83.

Furthermore, in order to prevent washing water from being introduced into the coupling part 83, the coupling part 83 may be filled therein with filler and the like.

More specifically, the front connector 8*a* is provided in the drum 3.

Body part 81 of the front connector 81 may be connected to the second front connecting line 673*a*. Second front connecting line 673*a* may extend through a front wall of the drum 3 and the housing 55 of the front balancer 51 and may be connected to the housing power line 555 of the front balancer 51.

Connecting part 85 of the front connector 8*a* may be connected to the first front connecting line 671*a*.

Therefore, the body part 81 of the front connector 8*a* and the connecting part 85 are connected to each other in the drum 3, and may be secured therein by means of the coupling part 83 of the front connector 8*a*.

First front connecting line 671*a* may have a longer length than that of the drum 3.

Accordingly, when the first front connecting line 671*a* is connected to the second front connecting line 673*a*, the first front connecting line 671*a* is pulled out of the front external surface of the drum 3 and may be connected to the second front connecting line 673*a* by means of the front connector 8*a*, and then the front connector 8*a* may be retracted into the drum.

As a result, the first front connecting line 671*a* is easily connected to the second front connecting line 673*a*.

The laundry treatment apparatus according to one embodiment of the present invention may further include a connector receptor 35 provided at the drum 3 to provide a space for accommodating the connector 8*a*.

Although not explicitly shown in the drawings, the connector receptor may be constructed in such a way that an inner circumferential surface of the drum 3 is longitudinally recessed (not shown). Therefore, the front connector 8*a* is received in the recessed space, thus avoiding collision with laundry.

Alternatively, the connector receptor may be constructed in such a way that an outer circumferential surface of the drum 3 is recessed (not shown) such that the front connector 8*a* is accommodated in the recessed space. In this case, the first connecting line 671*a* and the second connecting line 673*a* may be connected to each other on the outer circumferential surface of the drum 3.

Furthermore, the connector receptor may be constructed in such a way as to protrude from the inner circumferential surface of the drum 3 such that a predetermined space is defined in the protrusion to accommodate the front connector 8*a* therein.

The connector receptor (protruding from the inner circumferential surface of the drum 3) serves not only to prevent the front connector 8*a* from colliding with laundry contained in the drum 3 but also to agitate laundry contained in the drum 3 during rotation of the drum 3.

Rear connector 8*b* will now be described in more detail. Body part 81 of the rear connector 8*b* may be coupled to the second rear connecting line 673*b*. Second rear connecting line 673*b* may be connected to the housing power lines 555 of the rear balancer 53.

Here, the body part 81 of the rear connector 8*b* may be integrally formed with the housing 55 of the rear balancer 53.

Connecting part 85 of the rear connector 8*b* may be connected to the first rear connecting line 671*b*.

Accordingly, the connecting part 85 of the rear connector 8*b* may be connected to the body part 81 of the rear connector 8*b*, and may be held by means of the coupling part 83 of the rear connector 8*b*.

The first rear connecting line may have a predetermined length such that the first rear connecting line 671*b* is easily connected to the second rear connecting line 673*b*.

Figure 9:
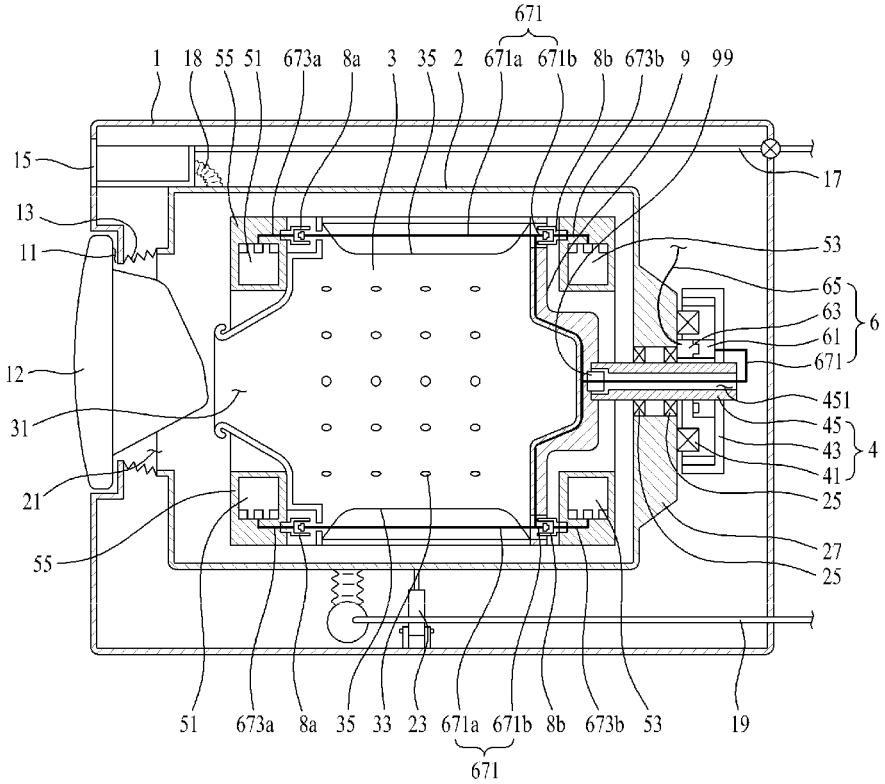
FIG. 9 is a cross-sectional view illustrating a laundry treatment apparatus according to a further embodiment of the present invention.

FIG. 9 is a view illustrating a laundry treatment apparatus according to a further embodiment of the present invention in which the body part 81 of the front connector 8*a* is integrally formed at the housing 55 of the front balancer 51. Hereinafter, only the difference between the laundry treatment apparatus according to this embodiment and that according to the embodiment shown in FIG. 4 will be described.

In this embodiment, the body part 81 of the front connector 8*a* may be coupled to the second front connecting line 673*a*, and the second front connecting line 673*a* may be connected to the housing power lines 555 of the front balancer 51.

Connecting part 85 of the front connector 8*a* may be coupled to the first connecting line 671*a* which extends outward from the inside of the drum 3 through the front wall of the drum 3.

Connecting part 85 of the front connector 8*a* may be connected to the body part 81 of the front connector 81, and may be held by means of the coupling part 83 of the front connector 8*a*.

While the above embodiments have been described in connection with the laundry treatment apparatus capable of washing laundry, the present invention may also be applied to a laundry treatment apparatus that is constructed only for the purpose of drying laundry.

Although the laundry treatment apparatus that is constructed only for the purpose of drying laundry may not need the tub 2, the cabinet 1 should be further provided therein with a drum support (not shown) for supporting the rotating shaft 45 and a hot air supply device (not shown) for supplying hot air into the drum.

Hereinafter, various examples of the power supply 6 provided in the laundry treatment apparatus according to the present invention will be described.

Figure 10:
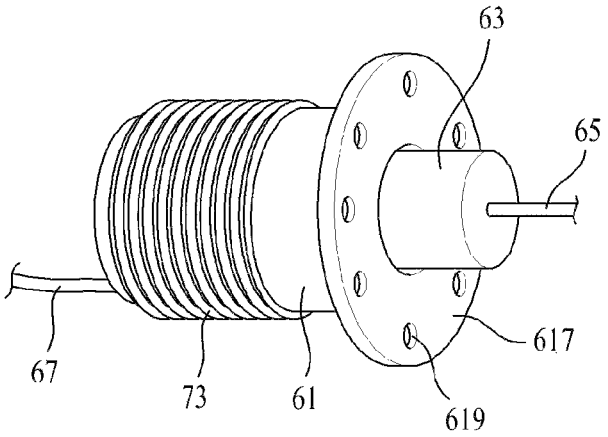
FIGS. 10 to 13 are views illustrating various power supplies incorporated in the laundry treatment apparatus according to the present invention.
Figure 10:
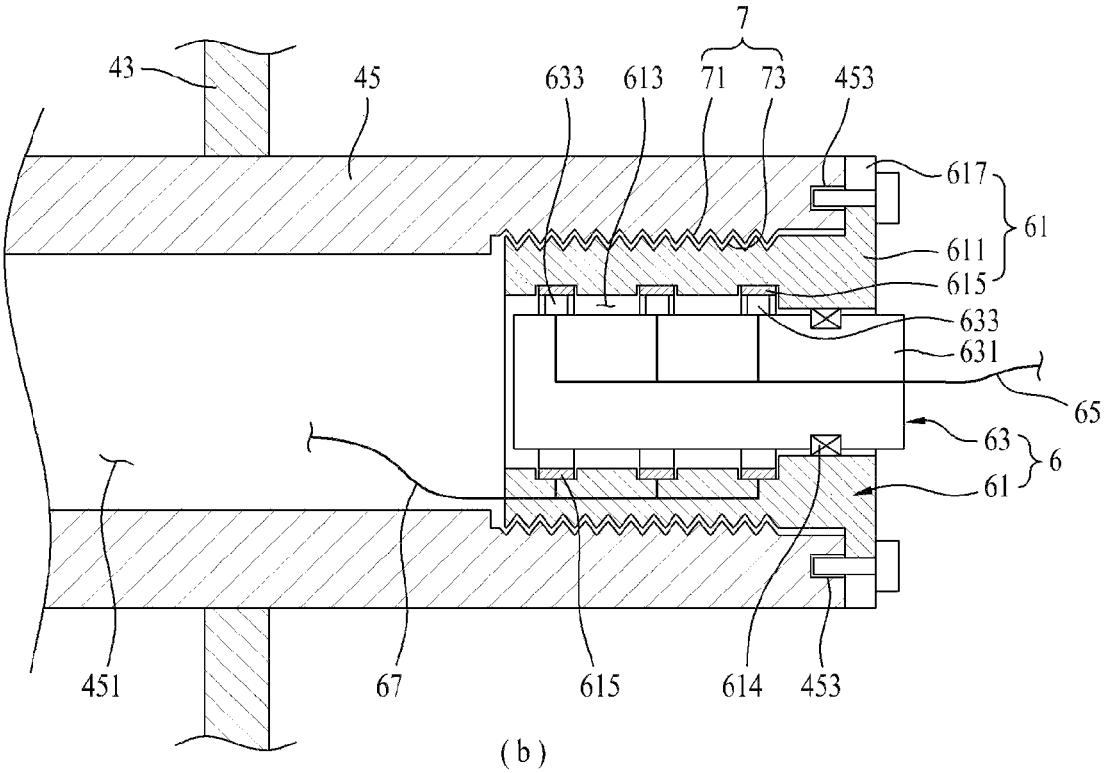

As shown in FIG. 10, the housing power lines 555 are supplied with electric power from a power source through the power supply 6. As shown in FIG. 4, the power supply 6 may include a first power supply unit 61 fixed to the rotating shaft 45 and connected to the housing power lines 555 (electrical connection), and a second power supply unit 63 rotatably fitted in the first power supply unit 61 to connect the power supply (electric power supply) to the housing power lines 555.

First power supply unit 61 may include a first body 611, an outer surface of which is fitted in a shaft through-hole 451, and a body through-hole 613 formed through the first body 611.

First body 611 may be formed into various shapes capable of being fitted in the shaft through-hole 451. FIG. 10 illustrates an example in which the first body has a cylindrical shape.

First body 611 is coupled to the rotating shaft 45 by means of a coupling unit 7.

FIG. 10 illustrates the coupling unit 7 which includes a male threaded section 71 formed on an outer peripheral surface of the first body 611, and a female threaded section 73 formed on an inner peripheral surface of the shaft through-hole 451.

Body through-hole 613 is longitudinally formed along the first body 611 and communicates with the shaft through-hole 451. First contact elements 615 are fixed to an inner peripheral surface of the body through-hole 613.

First contact elements 615 should be made of conductors that allow the flow of electrical current. Connected to the first contact element 615 is a connection line 67. Connection line 67 serves to connect the first contact element 615 to the housing power lines 555.

Rotating shaft 45 extends through the rear surface of the tub 2 and is fixed to the drum 3. Since the shaft through-hole 451 is longitudinally formed through the rotating shaft 45, the connection lines 67 which are disposed in the shaft through-hole 451 may extend to the housing power lines 555 disposed in the balancers 51 and 53.

Second power supply unit 63 includes a second body 631 rotatably fitted in the body through-hole 613, and second contact elements 633 provided at the second body 631 to contact the first contact elements 615.

Second body 631 may be formed into any shape that is rotatable in the body through-hole 613. FIG. 4 illustrates an example in which the second body 631 has a cylindrical shape.

Second body 631 is rotatably fitted in the body through-hole 613 via a bearing 614 secured to the inner peripheral surface of the body through-hole 613.

Second contact elements 633 should be made of a conductor material fixed to the second body 631, respectively, and are connected to a power source through a power line 65.

In the laundry treatment apparatus 100 according to one embodiment of the present invention having the above-described configuration, since the rotating shaft 45 and the first power supply unit 61 rotate together with the drum 4 whereas the second power supply unit 63 connected to the power source is rotatably fitted in the first power supply unit 61, there is no occasion that the connection line 67 is twisted or entangled even though the drum 3 rotates. Consequently, the present invention enables the balancing units 57 moving in the balancers to be supplied with electric power in a wired manner, that is, through the connection line 67.

Power supply 6 provided according to the present invention may further include a flange 617 provided at the first power supply unit 61, and fastening holes 453 formed at the rotating shaft 45, in order to firmly fasten the first power supply unit 61 to the rotating shaft 45.

Flange 617 may extend from an outer peripheral surface of the first body 611 (protruding away from the shaft through-hole 451). Flange through-holes 619 are formed through the flange 617 such that they communicate with the fastening holes 453.

Tightening bolts inserted through the flange through-holes 619 into the fastening holes 453 enable the first body 611 to be more firmly fastened to the shaft through-hole 451.

Figure 11:
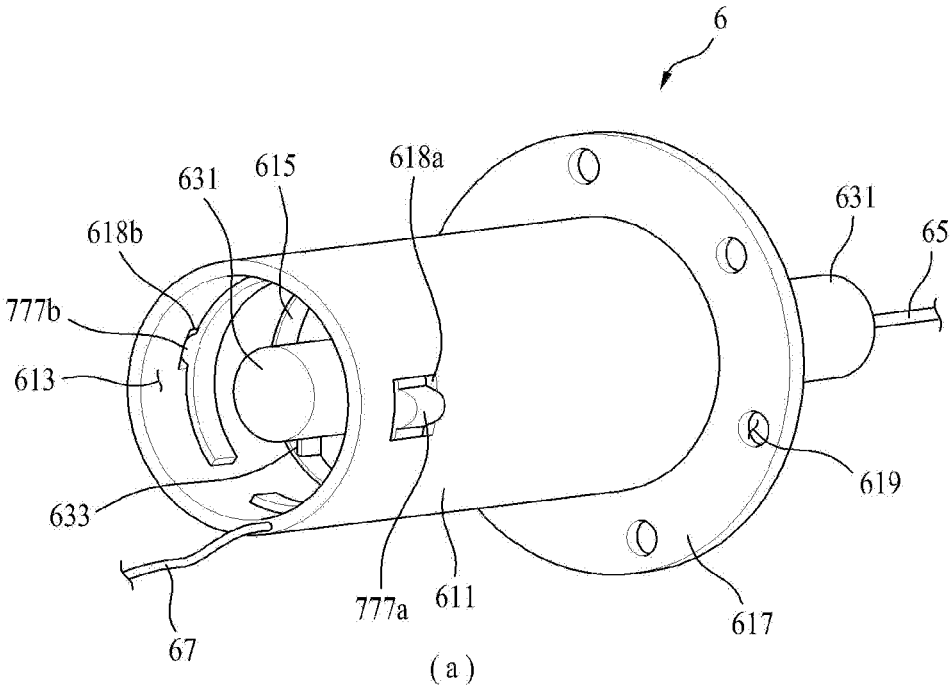
Figure 11:
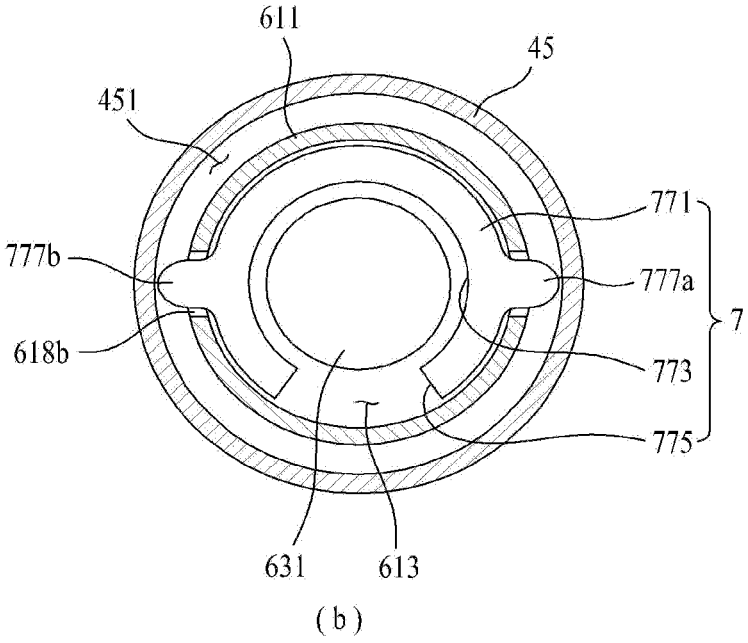

FIG. 11 illustrates another example of the power supply 6 according to the present invention.

Power supply 6 according to this example also includes a first power supply unit 61 fitted in the shaft through-hole 451 of the rotating shaft and connected to the housing power lines 555, and a second power supply unit 63 rotatably fitted in the first power supply unit 61 and electrically connected to the power source and the first power supply unit 61.

First power supply unit 61 according to this embodiment may include a first body 611 fitted in the shaft through-hole 451, a body through-hole 613 formed through the first body 611, and a first contact element 615 fixed to an inner peripheral surface of the body through-hole 613 and connected to the housing power lines 555 via the connection line 67.

Second power supply unit 63 may include a second body 631 rotatably disposed in the body through-hole 613, and a second contact element 633 provided at the second body 631 to contact the first contact element 615. The second body 631 is constructed to have the same configuration as that shown in FIG. 4, and is rotatably fitted in the first body 611.

Since the second contact element 633 is connected to the power source through the power line 65, electric power from the power source is supplied to the housing power lines 555 through the power line 65, second contact element 633, first contact element 631, and connection line 67.

Meanwhile, the power supply 6 is coupled to the rotating shaft 45 by means of a coupling unit 7. Coupling unit 7 may be composed of an elastic support that protrudes from the surface of the first body 611 to retain the first body 611 in the shaft through-hole 451.

The elastic supports may include a C-shaped support body 771 disposed in the body through-hole 613, and protrusions 777*a* and 777*b* protruding outward from the support body 771 through the first body 611.

In order to allow protrusions 777*a* and 777*b* disposed in the body through-hole 613 to protrude outward from the first body 611, the first power supply unit 61 may further include through-holes 618*a* and 618*b* formed in the first body 611.

The protrusion may be composed of only one single protrusion, for example, the protrusion 777*a* may protrude from the outer peripheral surface of the support body 771. Alternatively, a pair of protrusions 777*a* and 777*b* may protrude from the outer peripheral surface of the support body 771 as illustrated in FIG. 11. The distance between the free end of the first protrusion 777*a* and the free end of the second protrusion 777*b* is larger than the diameter of the shaft through-hole.

While FIG. 11 illustrates the case in which the first protrusion 777*a* and the second protrusion 777*b* are positioned to be opposite to each other with respect to the center of a through-hole 773, there is no need to restrict the position of the respective protrusions to those shown in FIG. 11.

Support body 771 is composed of an annular metal body (elastic body) that has the through-hole 773 formed therein and a cut sector 775 opened to allow the through-hole 773 to communicate with the outside. Consequently, when external force acting toward the center of the through-hole 773 is applied to the protrusions 777*a* and 777*b* and thus the support body 771 is deformed (the diameter of the through-hole 771 is varied), the support body 771 will exert restoring force to restore the original structure.

More specifically, in the power supply 6 according to this example, when the first body 611 is inserted into the shaft through-hole 451, the protrusions 777*a* and 777*b* are pressed toward the center of the through-hole 773 due to the inner peripheral surface of the rotating shaft 45 defining the shaft through-hole 451. In this state, restoring force of the support body 771 maintains the respective protrusions 777*a* and 777*b* in contact with the inner peripheral surface of the rotating shaft 45 defining the shaft through-hole 451. Therefore, the first body 611 is held with respect to the rotating shaft 45 owing to the frictional force generated between each of the protrusions 777*a* and 777*b* and the shaft through-hole 451.

Similarly to the previous example, the first body 611 may also be provided at the outer peripheral surface thereof with the flange 617 having the flange through-holes 619. In addition, the rotating shaft 45 may include the fastening holes 453 into which bolts are screwed through the flange through-holes 619.

Figure 12:
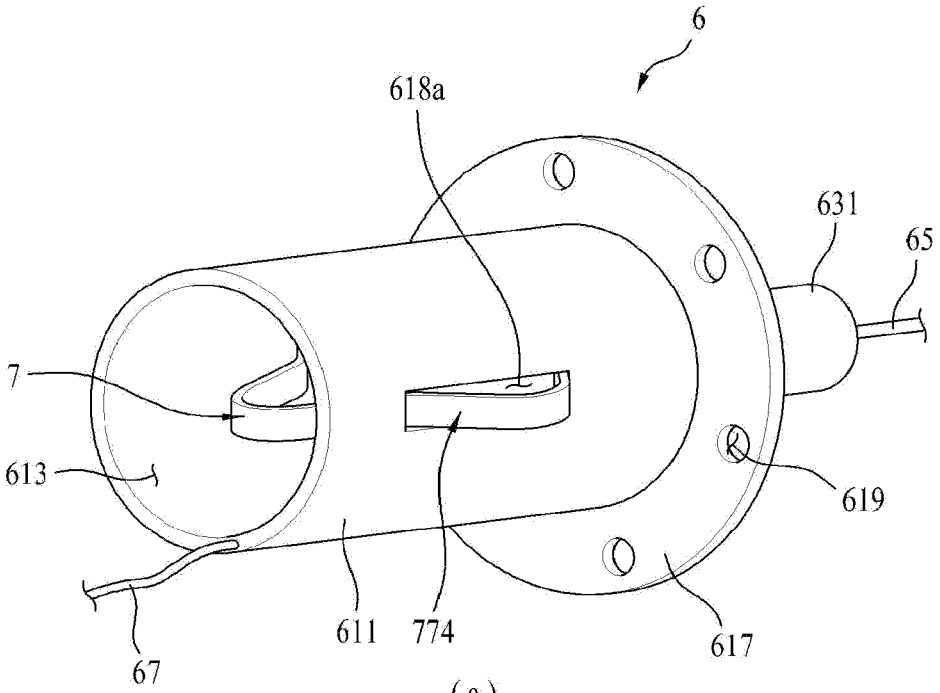
Figure 12:
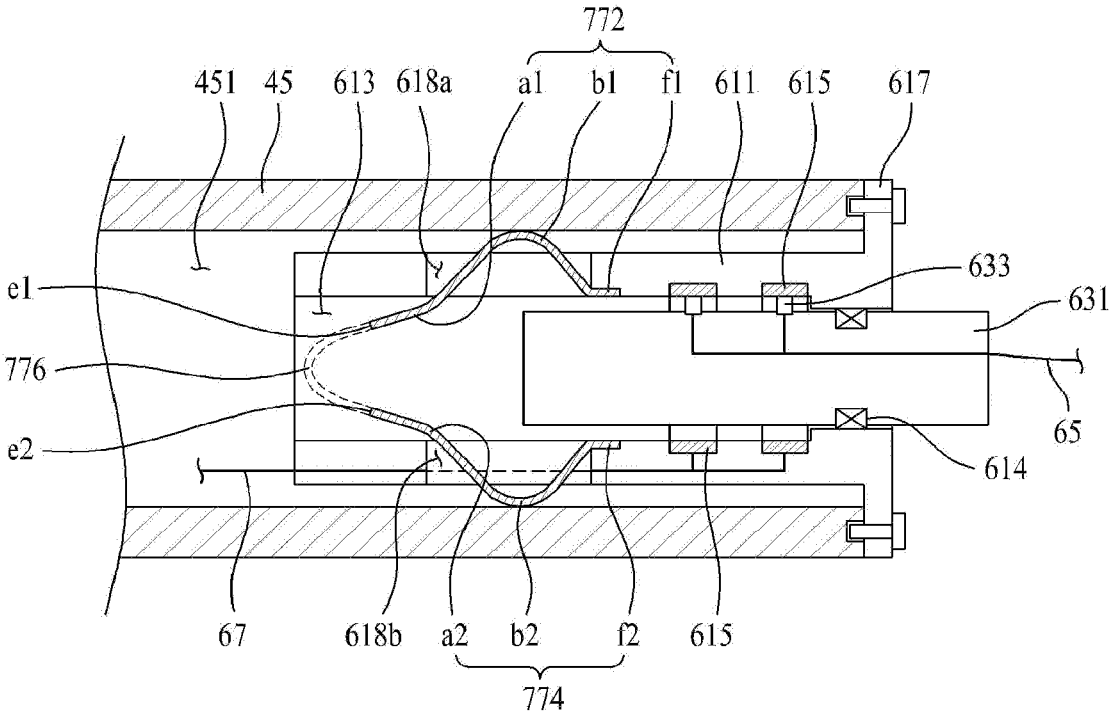

Power supply 6 shown in FIG. 12 is constructed to be almost identical to the power supply shown in FIG. 11, except for an elastic support.

The elastic support provided according to this example includes a first support 772 and a second support 774 which are fixedly disposed in the body through-hole 613 and protrude outward from the first body 611 through the through-holes 618*a* and 618*b* thus contacting the inner peripheral surface of the shaft through-hole 451.

First support 772 is composed of a first bar a1. First bar a1 has a stationary end f1 fixedly disposed, and a free end f1 of the first bar a1 freely disposed in the body through-hole 613.

A first bent portion b1 is provided between the first stationary end f1 and the free end e1, and protrudes outward from the first body 611 through the through-hole 618*a*.

Second support 774 may have the same structure as that of the first support 772. More specifically, the second support 774 is also composed of a second bar a2. Second bar a2 may include a second stationary end f2 fixedly disposed in the body through-hole 613, a free end e2 freely disposed in the body through-hole 613, and a second bent portion b2 provided between the second stationary end f2 and the second free end e2 and protruding outward from the first body 611 through the second through-hole 618*b*.

In the power supply 6 according to this example, when the first body 611 is inserted into the shaft through-hole 451, the bent portions b1 and b2 are pressed toward the center of the body through-hole 613 due to the rotating shaft 45. A distance between the free end of the first bent portion b1 and the free end of the second bent portion b2 is larger than the diameter of the shaft through-hole.

Meanwhile, the first and second bars a1, a2 are composed of an elastic body such as a metal body and fixed in the body through-hole 613 by means of stationary ends f1, f2 thereof, and, as such, the first and second bent portions b1 and b2 are maintained in the state that they are in contact with the rotating shaft 45 defining the shaft through-hole 451. Therefore, this embodiment enables the first body 611 to be held in place in the rotating shaft 45 by means of frictional force generated between each of the first and second bent portions b1 and b2 and the rotating shaft 45 defining the shaft through-hole 451.

In some cases, the elastic support may be composed of only one of the first and second support 772 and 774, and the first and second free ends e1 and e2 may be connected to each other via a connection section 776.

Similar to the previous embodiments, according to this embodiment, the first body 611 may also include the flange 617 which is formed on an outer peripheral surface of the first body 611 and has the flange through-holes 619, and the rotating shaft 45 may also include the fastening holes 453 into which bolts are screwed through the flange through-holes 619.

Figure 13:
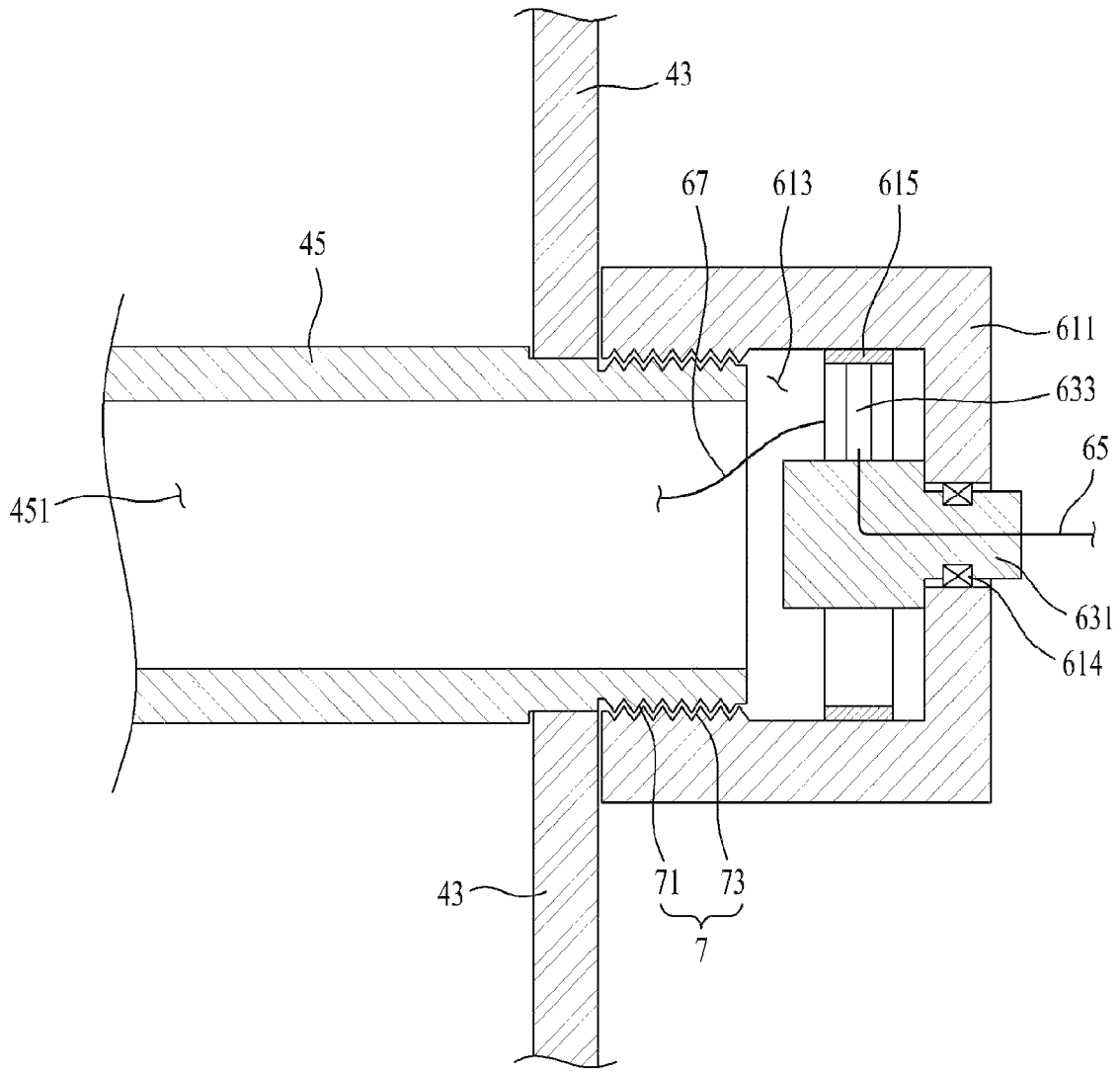

FIG. 13 illustrates a further example of the power supply 6 according to the present invention. Power supply 6 according to this example is discriminated from the previous embodiments in that the power supply 6 serves as not only a unit for supplying electric power to the housing power lines 555 but also a unit for securing the rotor 43 to the rotating shaft 45.

Power supply 6 according to this example may include a first power supply unit 61 fixed to the rotating shaft 45, which secures the rotor 43 to the rotating shaft 45 and is connected to the housing power lines 555, and a second power supply unit 63 rotatably fitted in the first power supply unit 61 to connect the housing power lines 555 to the power source.

First power supply unit 61 includes a first body 611 coupled to the outer peripheral surface of the rotating shaft 45 so as to secure the rotor 43 to the rotating shaft 45, a body through-hole 613 formed through the first body 611, and a first contact element 615 disposed along the peripheral surface of the body through-hole 613 and connected to the connection line 67.

First body 611 is coupled to the rotating shaft 45 by means of the coupling unit 7. Coupling unit 7 may include a female threaded section 73 formed on a peripheral surface of the body through-hole 613, and a male threaded section 71 provided at an outer peripheral surface of the rotating shaft 45 and threaded with the female threaded section 63.

Meanwhile, the second power supply unit 63 may include a second body 631 rotatably fitted in the first body 611 and disposed in the body through-hole 613, a second contact element 633 provided at the second body 631 so as to contact the first contact element 615, and a power line 65 for connecting the second contact element to the power source.

While the above embodiments have been described in connection with the laundry treatment apparatus 100 capable of washing clothes, the present invention may also be applied to a laundry treatment apparatus that is constructed only for the purpose of drying laundry.

Although the laundry treatment apparatus that is constructed only for the purpose of drying laundry may not need the tub 2, the cabinet 1 should be further provided therein with a drum support (not shown) for supporting the rotating shaft 45 and a hot air supply device (not shown) for supplying hot air into the drum.

The drum support (not shown) may be constructed into any configuration so long as such configuration may support the drum 3 in the inside of the cabinet 1. In this case, the rotating shaft 45 has to extend through the drum support while the stator 41 has to be fixed to the drum support.

Hereinafter, a process of controlling unbalance (vibration) of the laundry treatment apparatus 100 which is configured in the above-described manner will be described with reference to FIG. 2.

When laundry L is not evenly distributed along an inner peripheral surface of the drum 3 but is locally concentrated at a partial area of the drum 3, the drum rotates in an unbalanced state in which the drum generates vibration exceeding an allowable vibration range.

Whether or not the drum 3 is in the unbalanced state may be determined in various ways. In an example, the unbalanced state may be determined by detecting a rotational speed of the rotor 43 by a control unit (not shown) (the control unit receives data as to rotational speed of the rotor from a rotational speed-detecting unit).

The drum in the unbalanced state exhibits the highest rotational speed when laundry incurring the unbalanced state passes through the lowest point of the rotational orbit of the drum, and exhibits the lowest rotational speed when the laundry incurring the unbalanced state passes through the highest point of the rotational orbit of the drum.

Accordingly, in the case of a laundry treatment apparatus which determines whether a drum is in the unbalanced state by means of a unit for detecting a rotational speed of a rotor, it may also be possible to detect a position of laundry incurring the unbalance.

In this regard, when the unbalanced state of the drum and the position of laundry incurring the unbalance are detected, the control unit (not shown) transmits control data (control commands) to the balancing units 57 through the communication unit (not shown) and the unit communicator (not shown) (preferably through wireless transmission) so as to move the balancing unit 57 to a position at which the unbalanced state is attenuated.

In other words, the unit controller (not shown) moves the balancing units 57 such that force caused by laundry is attenuated (compensated) by the sum of forces caused by weights of the balancing units 57 (the balancing units move such that the force caused by the weights of the balancing units 57 is exerted in a direction opposite to the laundry), as illustrated in FIG. 2.

As described above, power required to move the balancing units 57 is supplied from the power supply 6 through the housing power lines 555 and the unit power lines 576.

More specifically, the power line 65 supplies electric power to the second contact element 633 provided at the second power supply unit 63, and the second contact element 633 transmits the electric power to the first contact element 615 of the first power supply unit which is configured to rotate with the drum 3. The first contact element 615 supplies electric power to the housing power lines 555 provided in the accommodation space 553 through the connection line 67. The balancing units 57 receive the electric power from the housing power lines 555 through the unit power lines 576.

Meanwhile, in order to control a moving distance or a moving direction of the balancing unit 57, the control unit (not shown) (or the unit controller) has to determine a current position of the balancing unit 57. According to the present invention, the control unit (not shown) may determine a current position of the balancing unit 57 by means of the protrusions 557 or the grooves (not shown) provided at the housing power lines 555.

Electrical current flowing through a conductor varies in magnitude at a deformed portion of the conductor. Accordingly, if the unit controller (not shown) measures a magnitude of electrical current supplied to the motor 573 and then transmits the measured magnitude to the control unit (not shown), the control unit (not shown) may determine positions of the balancing units.

In particular, when the number of the protrusions 557 (or grooves) formed on the housing power lines 555 is two (the protrusions 557 are spaced apart from each other by 180 degrees), the control unit (not shown) may move each balancing unit 57 to the corresponding protrusion 557 (each balancing unit is moved to an initial position) whenever the unbalanced state is released (whenever rotation of the drum is stopped).

The reason for this is to prevent the unbalanced state caused by the balancing units 57 when the drum is rotated again after the unbalanced state is released (rotation of the drum is stopped).

Figure 14:
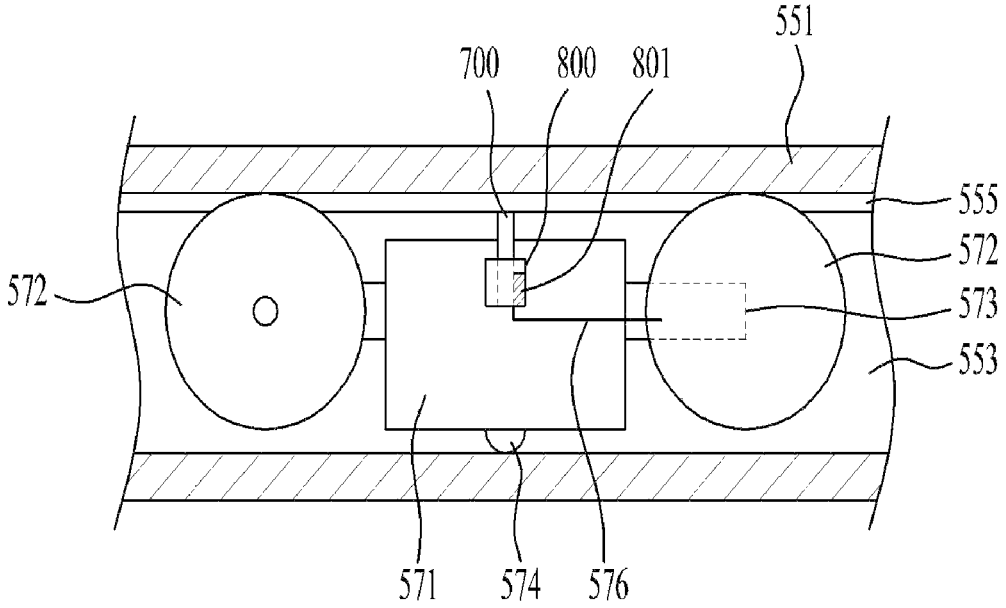
FIG. 14 is a cross-sectional view illustrating another example of the balancing unit according to the present invention.

FIG. 14 is a view illustrating another example of the balancing unit according to the present invention, which is supplied with power from the housing power lines 555 provided at the outer interior surface of the housing body 551 defining the accommodation space 553.

Housing body 551 defines the accommodation space 553 therein, and a balancing unit 57 is provided in the accommodation space 552.

As described above, the balancing unit 57 is moved by rotation of the motor 573 provided at the front or rear pair of wheels 572.

Housing power lines 555 provided at the inner surface of the accommodation space 553 supply power to the motor 573 provided at the balancing unit 57 to rotate the front or rear pair of wheels 572, thus causing the wheels 572 to be moved in the accommodation space 553.

Accordingly, there is a need to provide a unit for transmitting power between the housing power lines 555 for supplying power and the motor 573 for driving the balancing unit 57.

Figure 15:
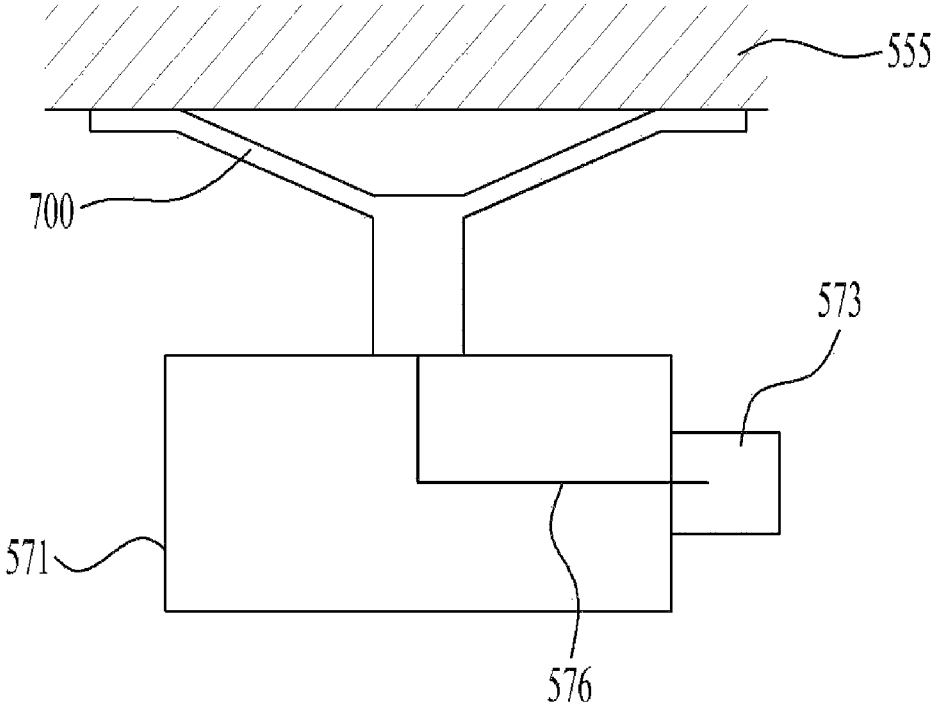
FIG. 15 is a view illustrating a brush included in a conventional balancing unit.

To this end, a conventional laundry treatment apparatus includes a brush 700 provided at the unit body 571 of the balancing unit 57, as illustrated in FIG. 15.

The conventional brush 700 is configured to have a "U" shape and to contact the housing power lines 555 at both ends thereof.

As described above, since the balancing unit 57 is movably provided in the accommodation space 553 and the brush 700 moves in the state of contacting the housing power lines 555, there is a problem that the brush 700 is deformed by the normal force caused by the centrifugal force.

Unlike the present invention which will be described hereinafter, since the conventional brush 700 is directly soldered to a unit power line 576 connected to the motor 573, the soldered portion suffers fatigue facture due to vibration generated during movement of the balancing unit 57 in the accommodation space 553.

In order to solve this problem, the brush 700 according to the present invention may be embodied by improving electrical contact between the conventional brush 700 and the unit power line 576. Detailed description thereof will now be given.

Figure 16:
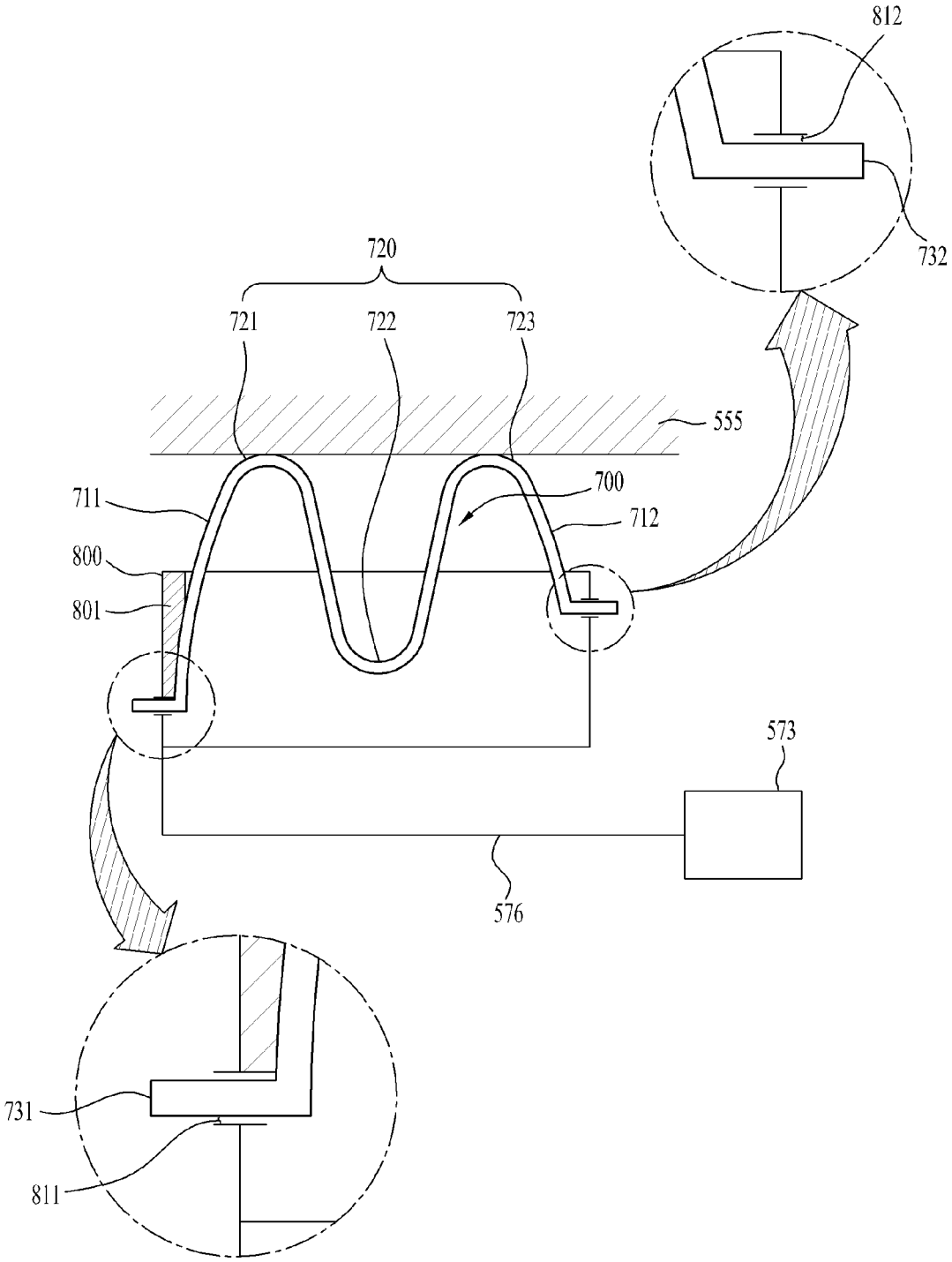
FIGS. 16 and 17 are cross-sectional views illustrating brushes according to the present invention.

FIG. 16 is a view illustrating an example of a brush and a contact terminal according to the present invention which is designed to solve the conventional problem.

Brush 700 may be configured to have an "M" shape.

Since the balancing unit 57 moves in the accommodation space 553 while the brush 700 of the balancing unit 57 is in contact with the housing power lines 555, the M-shaped structure of the brush 700 serves to reduce deformation of the brush 700 and to assure high reliability.

Brush 700 may have a first leg 711 formed at one end and a second leg 712 formed at the other end. Brush 700 may include a corrugated section 720 between the first leg 711 and the second leg 712.

First leg 711 may be configured to be longer than the second leg 712.

This serves to cause the first leg 711 to contact a power terminal 801 provided at a first socket 811 in which the first leg 711 is received.

A power terminal housing 800 is fixed to the unit body 571 and provides a space in which the brush 700 is removably installed.

Power terminal housing 800 is provided therein with the power terminal 801 connected to the unit power line 576 for transmitting power supplied from the housing power lines 555 to the motor 573.

Although FIG. 16 illustrates an example which is provided with one power terminal 801, a plurality of power terminals 801 may be provided if necessary.

Corrugated section 720 may include a second curved portion 722 having a "U" shape and first and third curved portions 721 and 723 having a "n" shape.

Since the brush 700 according to the present invention is configured to have the M-shaped corrugated section 720 including at least one curved portions and the brush 700 moving in the state of contacting the housing power lines 555, deformation of the brush 700 by the normal force caused by the centrifugal force is reduced.

In this example, the first and third curved portions 721 and 723 are in contact with the housing power lines 555 to receive power from the housing power lines 555.

One end of the power terminal 801 contacts the first leg 711 and the other end of the power terminal 801 contacts the unit power line 576.

Accordingly, the power supplied through the first and third curved portions 721 and 723 from the housing power lines 555 is transmitted to the power terminal 801 through the first leg 711 and then transmitted to the motor 573 through the unit power line 576.

Figure 17:
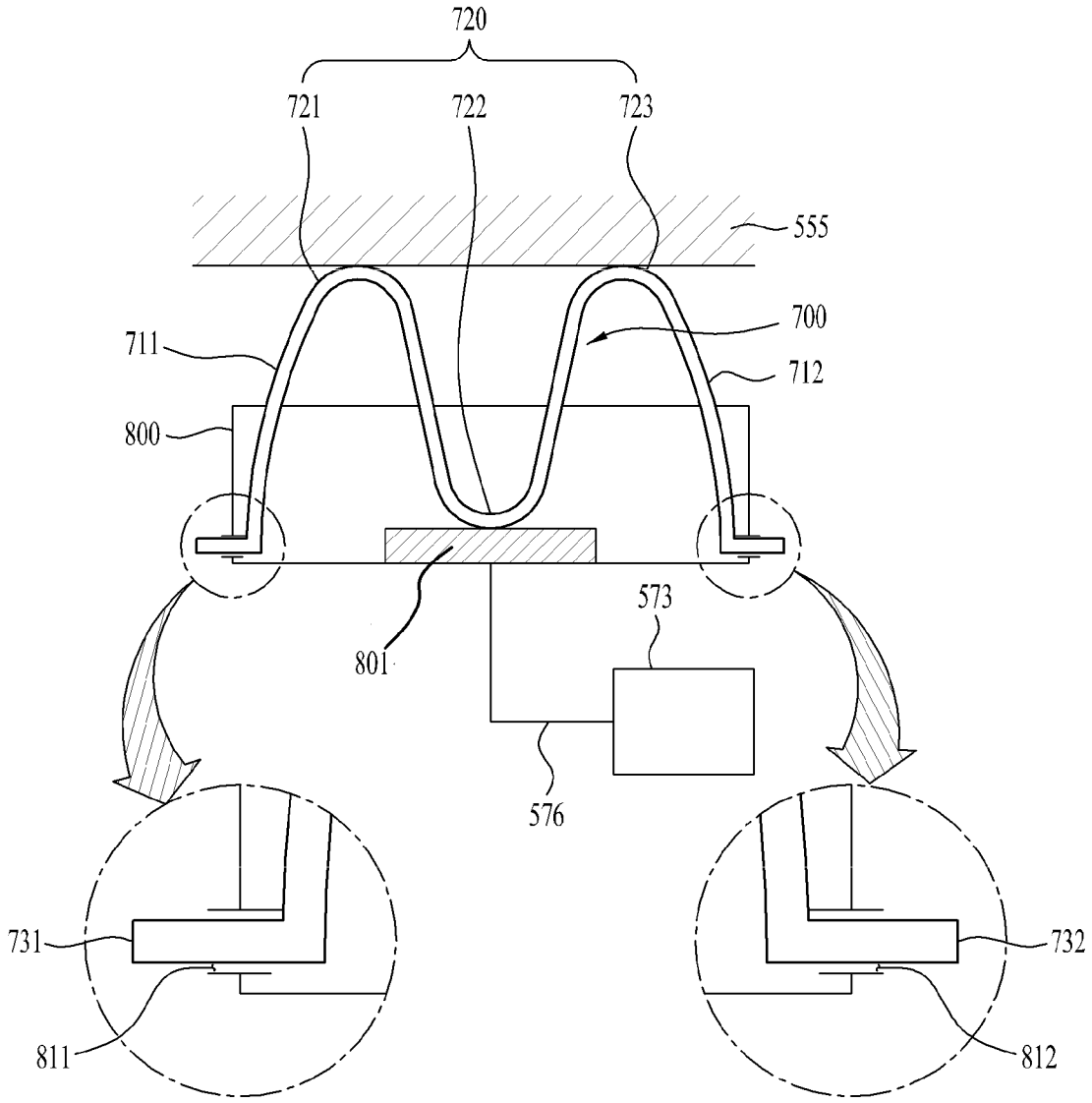

Second curved portion 722 is connected between the first curved portion 721 and the third curved portion 723, and is disposed in the power terminal housing 800. As illustrated in FIG. 17, the brush 700 may be inserted and installed such that an allowable space is defined between a lower surface of the power terminal housing 800 and the second curved portion 722.

This serves to prevent the second curved portion 722 from interfering with the lower surface of the power terminal housing 800 when the balancing unit 57 is vibrated while moving in the accommodation space 553.

Each end of the first leg 711 and the second leg 172 may include a fixing hook.

In conventional technologies, the end of the brush 700 is directly soldered to a power cable of the motor 573 in order to transmit power to the motor 573 from the brush 700. Unlike the conventional technology, the fixing hook according to the present invention may be removably fitted into the socket of the power terminal housing 800.

Since the balancing unit 57 may be vibrated while moving in the accommodation space 553, a soldered portion may be broken due to the vibration or shock.

Accordingly, in the present invention, since the fixing hooks provided at the ends of the brush 700 are removably fitted into the first and second sockets 811 and 812 of the power terminal housing 800, respectively, without connection by soldering, a risk of occurrence of fatigue fracture due to vibration is remarkably reduced.

More specifically, a first fixing hook 731 provided at the end of the first leg 711 may be removably fitted into the first socket 811 of the power terminal housing 800, and a second fixing hook 732 provided at the end of the second leg 712 may be removably fitted into the second socket 812 of the power terminal housing 800.

To this end, the brush 700 is preferably made of an elastic material.

Specifically, when the first and second legs 711 and 712 are pressed and inserted into the power terminal housing 800, the first fixing hook 731 is fitted into the first socket 811 of the power terminal housing 800 and the second fixing hook 732 is fitted into the second socket 812 of the power terminal housing 800. Thereafter, when the pressure applied to the first and second legs 711 and 712 is released, the brush 700 is removably installed in the power terminal housing 800 by the restoring force because the brush 700 is made of an elastic material.

FIG. 17 is a view illustrating another example of a brush and a power terminal according to the present invention, which is designed to solve the conventional problem.

Brush 700 may be configured to have an "M" shape.

Specifically, the brush 700 may include a first leg 711 and a second leg 712 provided at the opposite ends thereof and may include a corrugated section 720 between the first leg 711 and the second leg 712.

First leg 711 may be configured to have the same length as that of the second leg 712.

Corrugated section 720 may include a second curved portion 722 having a "U" shape and first and third curved portions 721 and 723 having an "n" shape.

In this example, the first and third curved portions 721 and 723 contact the housing power lines 555 to receive power from the housing power lines 555.

One end of the power terminal 801 contacts the first leg 711 and the other end of the power terminal 801 contacts the unit power line 576.

As illustrated in FIG. 17, the power terminal 801 is preferably disposed on the bottom surface of the power terminal housing 800 so as to contact the second curved portion 722.

Accordingly, the power supplied through the first and third curved portions 721 and 723 from the housing power lines 555 is transmitted to the power terminal 801 through the second curved portion 722 and then transmitted to the motor 573 through the unit power line 576.

Each end of the first leg 711 and the second leg 172 may include a fixing hook.

In conventional technologies, the end of the brush 700 is directly soldered to a power cable of the motor 573 in order to transmit power to the motor 573 from the brush 700. Unlike the conventional technology, the fixing hook 730 according to the present invention may be removably fitted into the socket 810 of the power terminal housing 800.

More specifically, a first fixing hook 731 provided at the end of the first leg 711 may be removably fitted into the first socket 811 of the power terminal housing 800, and a second fixing hook 732 provided at the end of the second leg 712 may be removably fitted into the second socket 812 of the power terminal housing 800.

As described above, at least one embodiment of the present invention can provide a laundry treatment apparatus including a balancing unit equipped with a brush that is not easily deformed.

In addition, embodiments of the present invention can provide a laundry treatment apparatus including a balancing unit equipped with a brush removably coupled to a connector.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treatment apparatus comprising:
a cabinet forming an appearance of the apparatus;
a drum rotatably disposed in the cabinet;
a housing fixed to the drum;
an accommodation space defined within the housing forming a closed loop;
a balancing unit movably disposed in the accommodation space; and
a housing power line provided at an inner circumferential surface of the housing to supply power to the balancing unit,
wherein the balancing unit comprises:
a unit body;
a motor for moving the unit body;
a brush contacting the housing power line; and
a power terminal housing fixed to the unit body and having a space in which the brush is removably installed,
wherein the brush comprises at least one curved portion including:
a first leg having two ends, one end fitted to the power terminal housing and the other end having a first curved portion to contact the housing power line to receive power from the housing power line;
a second leg having two ends, one end fitted to the power terminal housing and the other end having a third curved portion to contact the housing power line to receive power from the housing power line; and
a second curved portion positioned connected between the first curved portion and the third curved portion without contacting the housing power line.

2. The laundry treatment apparatus of claim 1, wherein
the first leg removably fitted into sockets at the power terminal housing;
the second leg removably fitted into sockets at the power terminal housing.

3. The laundry treatment apparatus of claim 2, further comprising:
at least one power terminal disposed in the power terminal housing to transmit power to the motor,
wherein the first leg is disposed to contact the power terminal.

4. The laundry treatment apparatus of claim 3, wherein the power terminal housing includes a unit power line connecting the power terminal to the motor to transmit power to the motor.

5. The laundry treatment apparatus of claim 2, wherein the first leg has a longer length than that of the second leg.

6. The laundry treatment apparatus of claim 2, further comprising:
at least one power terminal disposed in the power terminal housing to transmit power to the motor,
wherein the second curved portion is disposed to contact the power terminal.

7. The laundry treatment apparatus of claim 6, wherein the power terminal housing includes a unit power line connecting the power terminal to the motor to transmit power to the motor.

8. The laundry treatment apparatus of claim 1,
wherein the second curved portion is provided as a "U" shape.

9. The laundry treatment apparatus of claim 1,
wherein the first and third curved portions are provided as an "n" shape.

10. The laundry treatment apparatus of claim 1,
wherein the second curved portion is provided within the power terminal housing.

11. The laundry treatment apparatus of claim 1,
wherein the brush is "M" shaped.

12. The laundry treatment apparatus of claim 11,
wherein the ends of the "M" shaped brush are fitted into sockets at the power terminal housing, and the first curved portion and the third curved portion of the brush contact the housing power line.

* * * * *